US011282360B2

(12) United States Patent
Gandrud et al.

(10) Patent No.: US 11,282,360 B2
(45) Date of Patent: Mar. 22, 2022

(54) GEOGRAPHIC BOUNDARY COMPLIANCE DETECTION USING BODY-WORN OFFENDER MONITORING ELECTRONIC DEVICES

(71) Applicant: ATTENTI ELECTRONIC MONITORING LTD., Tel Aviv (IL)

(72) Inventors: Jonathan Dale Gandrud, Woodbury, MN (US); Guruprasad Somasundaram, Minneapolis, MN (US); Arash Sangari, St. Paul, MN (US); Robert W. Shannon, St. Roseville, MN (US); David Solomon Segal, Palm Harbor, FL (US); James William Howard, St. Paul, MN (US); Nicholas Andrew Asendorf, St. Paul, MN (US); Deepti Pachauri, St. Paul, MN (US); Saber Taghvaeeyan, St. Paul, MN (US); Tyler William Olson, St. Paul, MN (US)

(73) Assignee: ATTENTI ELECTRONIC MONITORING LTD, Tel Aviv (IL)

( * ) Notice: Subject to any disclaimer, the term of this patent is extended or adjusted under 35 U.S.C. 154(b) by 0 days.

(21) Appl. No.: 16/621,708

(22) PCT Filed: Jun. 14, 2018

(86) PCT No.: PCT/IL2018/050663

§ 371 (c)(1),
(2) Date: Dec. 12, 2019

(87) PCT Pub. No.: WO2018/229778

PCT Pub. Date: Dec. 20, 2018

(65) Prior Publication Data

US 2021/0142641 A1 May 13, 2021

Related U.S. Application Data

(60) Provisional application No. 62/520,619, filed on Jun. 16, 2017.

(51) Int. Cl.
*G08B 21/02* (2006.01)

(52) U.S. Cl.
CPC ..... *G08B 21/0261* (2013.01); *G08B 21/0263* (2013.01); *G08B 21/0269* (2013.01)

(58) Field of Classification Search
None
See application file for complete search history.

(56) References Cited

U.S. PATENT DOCUMENTS

2005/0033515 A1* 2/2005 Bozzone ..... G01C 21/12 701/472
2008/0252527 A1* 10/2008 Garcia ..... G01S 13/74 342/450

(Continued)

FOREIGN PATENT DOCUMENTS

WO 2013049102 A1 4/2013

*Primary Examiner* — John F Mortell
(74) *Attorney, Agent, or Firm* — Soroker Agmon Nordman

(57) ABSTRACT

A body-worn tracking device (BWTD) includes a global navigation satellite system (GNSS) device, at least one motion sensor, at least one processor, and at least one memory device. The at least one memory device includes instructions that, when executed by the at least one processor, cause the at least one processor to determine, based on data generated by the at least one motion sensor, a net distance between the last known location of the BWTD and a current location of the BWTD. The instructions further cause the at least one processor to determine, based on the net distance, whether the BWTD is within a bounded area that includes the last known location; and responsive to determining that BWTD is not within the bounded area, (Continued)

output an indication that the BWTD is not within the bounded area.

19 Claims, 9 Drawing Sheets

(56) References Cited

U.S. PATENT DOCUMENTS

| | | | | |
|---|---|---|---|---|
| 2012/0254934 | A1* | 10/2012 | McBrearty | G16H 40/63 725/118 |
| 2013/0076523 | A1* | 3/2013 | Kwan | A61B 5/0022 340/686.6 |
| 2015/0141873 | A1 | 5/2015 | Fei | |
| 2016/0116596 | A1 | 4/2016 | Rajala | |
| 2016/0117910 | A1 | 4/2016 | Rajala | |
| 2017/0193787 | A1* | 7/2017 | Devdas | G08B 21/0446 |

* cited by examiner

GEOGRAPHIC BOUNDARY COMPLIANCE DETECTION USING BODY-WORN OFFENDER MONITORING ELECTRONIC DEVICES

TECHNICAL FIELD

This disclosure relates to information systems for tracking geospatial location information related to monitored persons or objects.

BACKGROUND

Released criminal offenders on community supervision, either probation or parole, may be monitored with body-worn tracking devices (BWTDs) by a criminal justice supervising agency, such as a department of corrections or local law enforcement. The monitoring is based on a sentence, and often includes restricted regions and permissible regions with a schedule for the day of the week and a range of times associated with those areas when the released criminal offender is required to be or required not to be in those areas. A released criminal offender's geospatial location at a given date and time is monitored and recorded by tracking devices worn or carried by the released criminal offender. This geospatial information, including date and time information, can be used to determine a released criminal offender's compliance with their sentence. Activities of released criminal offenders can be reported to the criminal justice supervising agency or to a probation or parole officer by fax, page, text message or email generated by a monitoring center unique to the criminal justice supervising agency.

SUMMARY

Techniques of this disclosure are directed to detecting compliance with geographic boundaries using a body-worn tracking device (BWTD) worn by a monitored person. In some examples, a computing device (e.g., a BWTD, a server system, etc.) determines whether the BWTD is within a bounded geographic area when the BWTD is unable to determine its current location by using a Global Navigation Satellite System (GNSS). For example, the BWTD may lose connectivity to one or more GNSS satellites (e.g., GPS satellites) when the monitored person wearing the BWTD enters his or her place of employment. A monitored person wearing a BWTD may travel a large total distance while walking around his or her place of employment throughout the day, while never leaving the building. In some example implementations, the computing device may advantageously determine whether the BWTD is within the bounded geographic area based on a net distance between the last known location of the BWTD and the current location of the BWTD.

Rather than outputting a notification any time the BWTD loses a GNSS signal, the computing device may more efficiently output notifications in response to determining that the BWTD is not within the bounded area, which may advantageously reduce the burden on computing resources of the BWTD and/or a receiving computing system, the amount of data transferred between the BWTD and computing system, and/or generally the number of notifications processed and provided to the monitored person and/or law enforcement. Reducing the number of notifications may improve processing efficiencies, and case the burden on monitored persons and/or law enforcement in assisting monitored persons to stay within permitted geographic boundaries.

In an example, a body-worn tracking device (BWTD) includes a global navigation satellite system (GNSS) device, at least one motion sensor, at least one processor, and at least one memory device. The at least one memory device includes instructions that, when executed by the at least one processor, cause the at least one processor to, responsive to determining that a current location of the BWTD cannot be determined using the GNSS device, determine, based on data generated by the at least one motion sensor, a net distance between the last known location of the BWTD and the current location of the BWTD. The instructions further cause the at least one processor to determine, based on the net distance, whether the BWTD is within a bounded area that includes the last known location; and responsive to determining that BWTD is not within the bounded area, output an indication that the BWTD is not within the bounded area.

In another example, a method includes determining, by at least one processor of a body-worn tracking device (BWTD), that a location detection component is unable to determine a location of the BWTD; and responsive to determining that a current location of the BWTD cannot be determined using a global navigation satellite system (GNSS) device of the BWTD, determining, by the at least one processor and based on data generated by at least one motion sensor of the BWTD, a net distance between the last known location of the BWTD and a current location of the BWTD. The method also includes, determining, by the at least one processor and based on the net distance, whether the BWTD is within a bounded area that includes the last known location; and responsive to determining that BWTD is not within the bounded area, output, by the at least one processor, an indication that the BWTD is not within the bounded area.

The details of one or more examples are set forth in the accompanying drawings and the description below. Other features, objects, and advantages of the disclosure will be apparent from the description and drawings, and from the claims.

DETAILED DESCRIPTION

Figure 1:
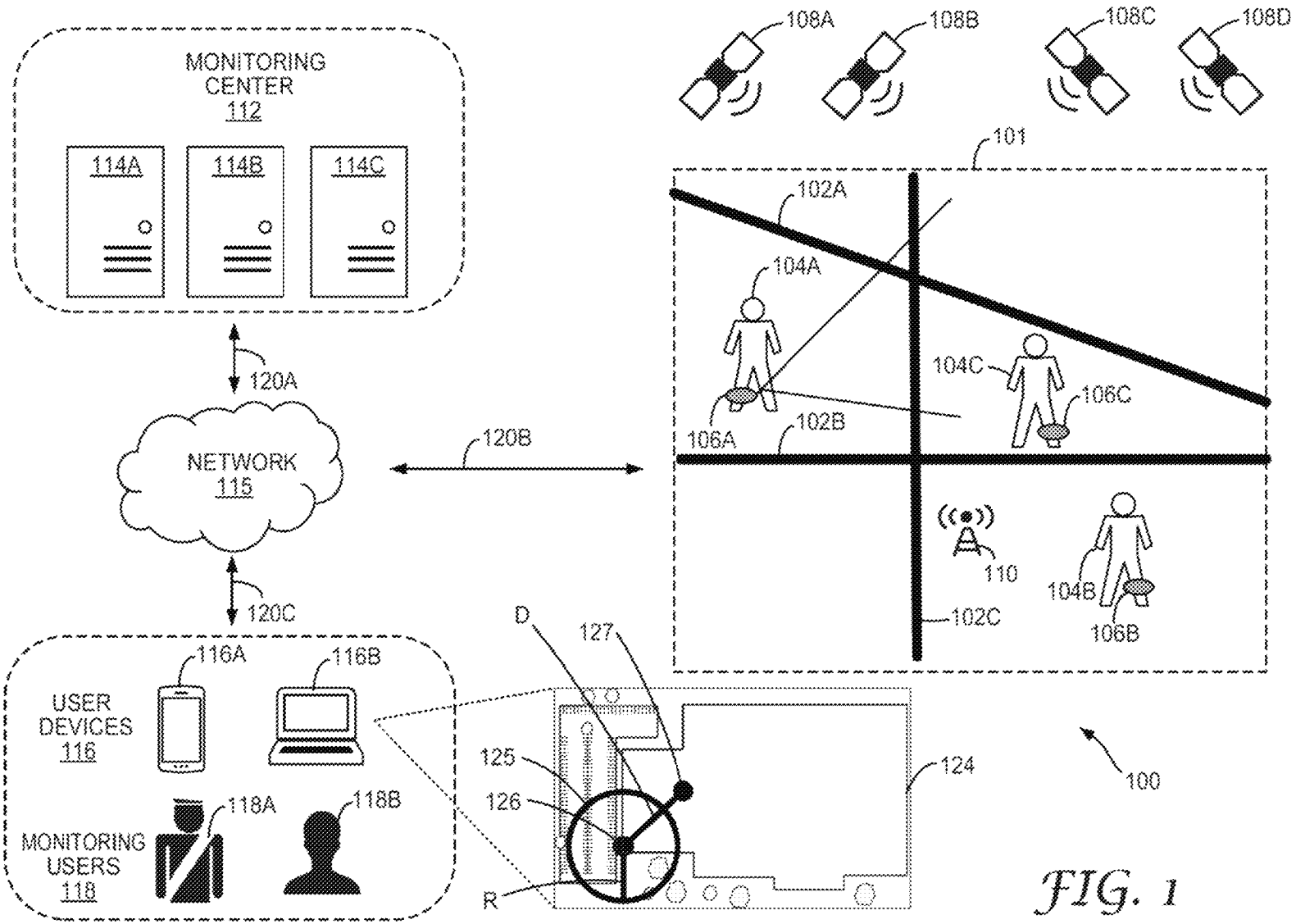
FIG. 1 is a conceptual diagram illustrating an example system for determining whether a body-worn tracking device is within a bounded geographic area, in accordance with techniques of this disclosure.

In an offender monitoring system, each offender is typically assigned a device (e.g., a body-worn tracking device (BWTD)) that determines and stores a variety of data such as location, speed, heading, or the like at prescribed intervals (e.g., every minute). The device typically includes a Global Navigation Satellite System (GNSS) device (e.g., a Global Positioning System (GPS) receiver) to help determine when the offender violates the terms of his or her parole (e.g., by entering prohibited geographic areas or exiting permitted areas). However, GNSS devices may temporarily lose connectivity to one or more GNSS satellites, for example, due to surrounding structure or environmental features. Losing connectivity to one or more satellites may prevent the BWTD from determining current GNSS coordinates of the BWTD, which may limit the ability of law enforcement to ensure the offender complies with the terms of his or her parole.

When a BWTD is unable to determine the BWTD's current location using a GNSS device, a processor within the BWTD may programmatically apply rules to determine whether the offender has violated his or her parole by determining whether the offender is within a permitted distance from the last known location. In some instances, the BWTD determines whether the offender is within a permitted distance of the last known location by estimating a total distance traveled since the GNSS coordinates could no longer be determined. For instance, the BWTD may include one or more motion sensors to detect a plurality of steps, and may determine the total distance by based on the number of steps and distance of each step. If the total distance traveled is greater than a threshold distance, the offender monitoring system may generate an alert indicating the offender should go outside so that the BWTD can determine the current GNSS coordinates of the BWTD. However, in some situations, an offender wearing a BWTD may traverse an area (e.g., walk throughout his or her place of employment) while starting and ending in substantially the same geographic location (e.g., within the same building). In such situations, the offender monitoring system may nevertheless determine that the total distance traversed by the offender during the period while the BWTD is unable to determine the current GNSS coordinates of the BWTD exceeds a threshold, which may in turn trigger the offender monitoring system to output a message or alert instructing the offender to proceed to an area where the GNSS coordinates can be determined (e.g., go outside) even though the offender in fact remains within the permitted area.

Techniques of this disclosure may enable an offender monitoring system to determine whether the BWTD is within a permitted area by determining a net distance between the last known location of the BWTD and a current location of the BWTD when current GNSS coordinates of the BWTD cannot be determined. In some instances, the offender monitoring system also determines the direction of the current location relative to the last known location. In other words, when current GNSS coordinates of the BWTD cannot be determined, the offender monitoring system may determine whether the BWTD is within a bounded area that includes the last known location of the BWTD based on the net distance between the last known location and the current location, and optionally, the direction of the current location relative to the last known location. In some examples, the BWTD may temporarily disable or reduce the polling interval (e.g., how often the GNSS device communicates with the GNSS satellites) while the BWTD is within the bounded area, which may improve battery life of the BWTD.

If the offender monitoring system determines that the BWTD is not within the bounded area, the offender monitoring system may output an indication that the BWTD is not within the bounded area. However, if the BWTD and/or computing system determines that the BWTD is within the bounded area, the offender monitoring system refrains from outputting an alert. Rather than generating alerts based on total distance traveled, generating alerts only when the net distance indicates the BWTD is outside a permitted bounded area may more accurately determine when an offender is outside a permitted bounded area. More accurately determining when the offender is outside the permitted area may reduce the number of notifications and data transferred between the BWTD and a monitoring computing system, thus potentially reducing network traffic and increasing battery life of the BWTD. Further, more accurately determining when the offender is outside the permitted area may reduce the time and resources consumed by law enforcement in supervising offenders. Additionally or alternatively, more accurately determining when the offender is outside the permitted area may reduce how often a monitored offender needs to go outside so that the BWTD can reacquire a GNSS signal.

According to aspects of this disclosure, in some examples, a backend computing system generates and outputs a user interface having a graphical representation of the bounded area such that the administrator may adjust the bounded area. For example, the boundary may include a circle centered on the location where the BWTD lost the GNSS signal, and the computing system may output a graphical user interface that displays the radius of the circle. The computing system may receive a user input to adjust the radius of the circle, thus changing the geographic bounded area within which the monitored person is authorized to travel. In some instances, the bounded area may be any other regular or irregular shape, such as the shape of a particular building. For instance, the computing system may output a graphical user interface that includes a map of the place of employment for the monitored person and may receive a user input (e.g., from a law enforcement administrator) adjusting the bounded area to correspond to the shape of the building. In some examples, in response to changing the bounded area, the computing system sends an indication of the updated bounded area to the BWTD. The updated bounded area may correspond to only the first location (e.g., the monitored person's place of employment) or may be a global boundary for all locations (e.g., the location of the monitored person whenever the BWTD loses a GNSS signal). BWTD may store an indication of updated bounded area within a memory of the BWTD. Thus, if BWTD subsequently loses a GNSS signal, the BWTD may determine whether the BWTD is within the updated bounded area.

FIG. 1 is a conceptual view illustrating an example system 100 for determining whether a body-worn tracking device is within a bounded geographic area, in accordance with techniques of this disclosure. FIG. 1 illustrates a geographic region 101, which may be a portion of the Earth's surface. In this example, geographic region 101 includes multiple roads 102A-102C ("roads 102") on which monitored persons may travel. Geographic region 101 may include human built structures (e.g., houses, buildings, and the like) and/or natural structures (trees, mountains, oceans, lakes, and the like). In some examples, geographic region 101 may be visually represented in a map, which may be two- or three-dimensional. Such maps may be output for display by computing devices as further described in this disclosure. In the example of FIG. 1, a map generated based on geographic region 101 may be visually similar in appearance to the representation of geographic region 101 as illustrated in FIG. 1.

System 100 may track the location of one or more monitored persons 104A-104C ("monitored persons 104"). A monitored person may be any person wearing a BWTD, such as BWTD's 106A-106C which are respectively worn by monitored persons 104A-104C. In other examples, a "monitored person" may be interpreted as a non-human object to which a BWTD is attached. For instance, a monitored person may also be a vehicle, animal, or any other movable object that may move to different locations in a geographic area. In examples where a monitored person is non-human, the BWTD may be any device that is attached to, accompanies or is otherwise physically associated with the movable object, even if not necessarily bodily worn.

In the example of FIG. 1, monitored persons 104 may be released criminal offenders, although in other examples monitored persons may be any person. Released criminal offenders may include criminal offenders who have been suspected, accused, or convicted of a crime and released from a jail or prison. In such scenarios, system 100 may monitor the location of monitored persons 104. For instance, when monitored person 104A is released from jail or prison, a BWTD may be attached by law enforcement to the body of monitored person 104A As further described in this disclosure, the BWTD may have a unique device identifier that is associated with personally identifying information of monitored person in a monitor center. In this way, as monitored person 104A moves to different locations in a geographic region, geographic location points generated by the BWTD and stored at the monitoring center may be associated with or otherwise attributed to monitored person 104A, such that the location and/or whereabouts of person 104A may be monitored.

In the example of FIG. 1, each of monitored persons 104A-104C are respectively wearing a BWTD 106A-106C. Each BWTD 106A-106C may have similar or the same functionality and construction. BWTD 106A may be a portable computing device that determines the location of a monitored person and reports such locations to a monitoring center or other physically separate computing device. BWTD 106A may include a physical housing constructed of plastic or any other suitable material. The housing may include electronics such as, but not limited to: one or more computer processors, one or more memories, one or more wired and/or wireless communication devices (e.g., cellular network component, WiFi component, short-range (e.g., NFC, Bluetooth component, USB component), one or more output devices (e.g., haptic feedback component, lights, user interface display components, audio components), one or more GNSS components (e.g., a GPS receiver), one or more motion sensor components (e.g., an accelerometer, a gyroscope, etc.), power sources (e.g., battery, power supply), and one or more printed circuit boards that physically, communicatively, and/or electronically couple such electronic devices to one another within the housing of the BWTD.

GNSS components may include a combination of software and hardware components to receive satellite signals from satellites on a satellite network, such as the GPS satellite network, the Galileo satellite network, the GLONASS satellite network, or other government or commercially operated satellite network. Each satellite signal received by the GNSS components from a particular satellite of satellites 108 includes data such as the current position of the particular satellite and the current time.

In some examples, BWTD 106A is a one-piece design in which GNSS hardware and all other hardware for the BWTD are included in a single physical housing. In other examples, BWTD 106A may not include GNSS hardware, which may be physically separate from but in communication with the BWTD. For instance, the monitored person may carry a physical device with GNSS hardware (e.g., such as a telephone having GPS functionality), and separately the BWTD may be attached to the monitored person and in communication with the GNSS hardware. Further details of the components included within BWTD 106A are illustrated and described in FIGS. 2 and 3.

In some examples, BWTD 106A may farther include a combination of software components and hardware components to perform one or more monitoring functions. For instance, BWTD 106A may include a location detection component comprised of hardware and/or software that communicates with the GNSS hardware component to determine and record GNSS coordinates of BWTD 106A. For example, location detection components may receive the data from a plurality of satellites 108 (e.g., data indicative of the position of a particular satellite) via the GNSS components and may determine GNSS coordinates of BWTD 106A based on the data received from the plurality of satellites 108. In some examples, the location detection component sends such GNSS coordinates of BWTD 106A to a monitoring center or other physically separate computing device.

BWTD 106A includes one or more sensor components comprised of hardware and/or software that detects movement of BWTD 106A. In some examples, the one or more sensor components include a plurality of motion sensing components, such as an accelerometer and a gyroscope. BWTD 106A may receive acceleration data that indicates an amount of acceleration in at least a vertical direction (e.g., perpendicular to the earth's surface) from the accelerometer and may detect a plurality of steps (also referred to as strides) based on the acceleration data. BWTD 106A may determine a change in the orientation (e.g., direction) of BWTD 106A for each step based on orientation data received from the gyroscope. In some examples, the one or more sensor components include a magnetometer. BWTD 106A may determine the direction of BWTD relative to earth's magnetic field based on data received from the magnetometer. In some examples, BWTD 106A sends raw data (e.g., acceleration over time) or processed data (e.g., number of steps, length and direction of each step, or net distance) to a monitoring center or other physically separate computing device.

BWTD 106A may include a notification component comprised of hardware and/or software that generates notifications when BWTD 106A is within a restricted area or leaves a permitted area. A restricted area may be a region in which a monitored person may not enter or a region surrounding a location from which the monitored person (and therefore BWTD) must be separated from by at least a defined or specified distance. A permitted area may be a region in which the monitored person is permitted to be within, which may be any area that is not a restricted area. In some examples, a permitted area may include a limited area surrounding a location at which the BWTD loses a GNSS signal. Data stored on a BWTD that define restricted and/or permitted areas may be provided by a monitoring center or any other computing device that is physically separate from BWTD 106A.

BWTD 106A includes a communication component comprised of hardware and/or software that sends and receives data with a cellular network. The communication component may initiate, manage, and terminate communication sessions between cellular network infrastructure and BWTD 106A. Cellular network infrastructure may provide a wireless network for data communication to and from BWTD 106A over a geographically distributed area. In some examples, cellular network infrastructure may be owned and operated by a third-party, wireless or cellular carrier provider. Examples of such cellular networks may include a set of one or more geographically dispersed towers with radios, antennas and/or other communications components that provide for data communication with BWTD 106A using one or more protocols such as 2G, 3G, 4G, Long-Term Evolution (LTE), or any other suitable protocol. As BWTD 106A moves into and out of proximity of different towers. BWTD 106A may initiate and terminate communication sessions between BWTD 106A and the various towers, where a tower may be a Base Station Transceiver in a wireless communication network, such as a cellular network.

In some examples, BWTD 106A includes a management component comprised of hardware and/or software to manage BWTD 106A. The management component may write data to memory of BWTD 106A that is received from a monitoring center or other physically separate computing device. Data may include restricted regions and/or restricted locations, configuration data to configure one or more components of BWTD 106A, information that uniquely identifies BWTD 106A and/or monitored person 104A that is wearing BWTD 106A, or any other suitable information.

Components such as the location detection component, motion sensor components, notification component, communication component, and management component may perform operations described herein using software, hardware, firmware, or a mixture of both hardware, software, and firmware residing in and executing on BWTD 106A or at one or more other remote computing devices. In some examples, BWTD 106A may execute its various components when embodied in software with one or more processors to perform the functionality described in this disclosure. BWTD 106A may execute any of such components as or within a virtual machine, userspace application, operating system or any other operating environment executing on underlying hardware.

As shown in FIG. 1, system 100 may include one or more satellites 108A-108D ("satellites 108"). In some examples satellites 108 may comprise a set of global navigation satellites in a global navigation satellite system (GNSS). Satellites 108 continuously transmit their current time and position. As described above, BWTD 106A may include a GNSS component that monitors multiple satellites to determine the position of BWTD 106A. Although only four satellites 108A-108D are shown, different numbers of satellites may be used by BWTD 106A to determine the GNSS coordinates of BWTD 106A at a point in time.

System 100 may also include one or more towers, such as tower 110 that form cellular network infrastructure. Tower 110 may include a physical structure that supports antennae, a GNSS receiver, one or more sets of digital signal processors, transceivers, and control electronics, which collectively operate to establish sessions with end-user devices such as BWTDs, smartphones, or any other computing device. Tower 110, together with one or more other towers that include similar functionality, may be geographically dispersed, such as to provide a geographically dispersed wireless network for voice and/or data communication. Tower 110 and switching infrastructure (not shown) may be owned and operated by wireless or cellular carrier providers that charge customer/subscribers fees to operate on the wireless or cellular carrier provider.

Figure 4:
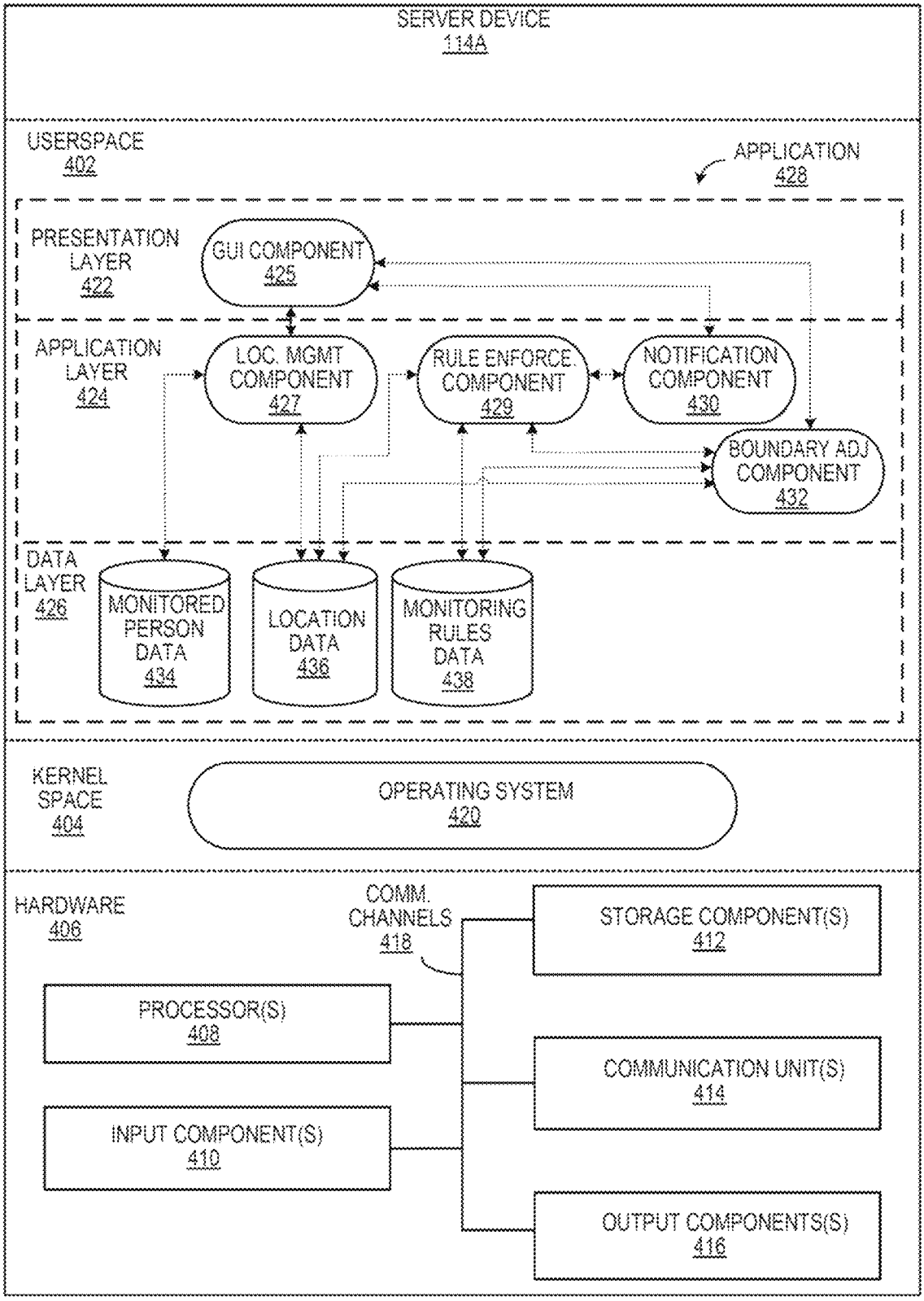
FIG. 4 is a block diagram illustrating an example computing device, in accordance with one or more aspects of the present disclosure.

FIG. 1 also includes monitoring center 112. Monitoring center 112 may be owned and operated by a private entity or a government entity. Monitoring center 112 includes one or more computing devices, such as server devices 114A-114C ("server devices 114"). Further details of the components included within server devices 114 is illustrated in FIG. 4. Server devices 114 may collectively provide a data center to monitor and track monitored persons based on, among other data, GNSS coordinates of BWTDs that are provided to server devices 114.

In some examples, server devices 114 may store an association between a monitored person and a respective BWTD worn by the monitored person. For instance, at the time that a law enforcement officer attaches a BWTD to the monitored person, the law enforcement officer may, using a separate, end-user computing device in communication with monitoring center 112, provide user input that creates an association between a unique identifier of the monitored person and a unique identifier of the BWTD. For instance, the association may be stored as a record in a database. As GNSS coordinates are received by monitoring center 112 from the BWTD with the unique identifier of the BWTD, monitoring center 112 may store such GNSS coordinates in association with the unique identifier of the BWTD. In this way, an operator of monitoring center 112 may determine the GNSS coordinates associated with a particular monitored person.

Monitoring center 112 may receive configuration input from users, such as law enforcement officers, that define restricted and/or permitted areas. Such configuration input may be sent by a computing device of the user to monitoring center 112 via network 115. The configuration input may specify a unique identifier of the monitored person and/or BWTD and may also include properties such as named locations, perimeters, GNSS coordinates or any other properties that may be used to define restricted and/or permitted areas. By associating restricted and/or permitted areas with a BWTD and/or monitored person wearing the BWTD, monitoring center 112 can determine violations, such as, determining whether a monitored person is operating within a restricted area and/or exits a permitted area.

In some examples, if monitoring center 112 determines that a monitored person in violation of a permitted area (e.g., has exited a permitted area), monitoring center may send one or more notifications. In some examples, monitoring center 112 may send a notification via network 115 to the BWTD for the violation, which may cause the BWTD to output an alert (e.g., haptic, visual, and/or audio feedback). In some examples, monitoring center 112, in response to detecting a violation, may send notifications to one or more other users, who may be associated with the monitored person who is in violation. For instance, to determine the one or more other users associated with the monitored person, monitoring center 112 may store within a record of a database a unique identifier of a law enforcement officer in association with a unique identifier of a monitored person.

Monitoring center 112 may generate user interfaces for display, such as maps that indicate different locations at which a monitored offender has been physically present. In some examples, monitoring center 112 may illustrate different locations at which a monitored offender has been physically present over a period of time. Monitoring center 112 may output any data that is stored in any suitable format including still and moving image data, audio data, and the like.

System 100 also includes user devices 116A-116B ("user devices 116") and monitoring users 118A-118B ("monitoring users 118") who use user devices 116. User devices 116 may be a computing device including, but not limited to a laptop computer, a tablet computer, a smartphone, a desktop computer, a server computer, a body worn computer (e.g., smartwatch, head-mounted device), or any other suitable computing device. User devices 116A and 116B may have similar or the same components and functionality, in some examples.

User device 116A may include one or more components comprised of a combination of hardware and software. For instance, user device 116A may execute a monitoring application implemented in software and executable on hardware of user device 116A. The monitoring application may provide notifications of violations, maps or other visual representations of monitored offender locations based on real-time or past-generated GNSS coordinates. The monitoring application may also generate and send that associates a unique identifier of a BWTD with a unique identifier of a monitored person. In some examples, the monitoring application may natively implement functionality described in this disclosure, while in other examples the monitoring application may be a web-browser that accesses a web-based application with such functionality via a web-hosted application executing at monitoring center 112.

Monitoring users 118 may include law enforcement, parole officers, or any other public safety officials or employees. In some examples, monitoring users 118 may also include non-public safety offices/employees, such as past or potential victims of a monitored offender, school administrators, or any other potential user that may be interested in or need to know of the location or violations of a monitored offender. Monitoring users 118 may receive notifications by using user devices 116, which are sent by monitoring center 112.

Network 115 may represent a publicly accessible computer network that is owned and operated by a service provider, which is usually large telecommunications entity or corporation. Although not illustrated, service provider network 115 may be coupled to one or more networks administered by other providers, and may thus form part of a large-scale public network infrastructure, e.g., the Internet. Network 115 may provide computing devices such as BWTD, user devices, and monitoring center 112 with access to the Internet, and may allow the computing devices to communicate with each other. In some examples, network 115 may include one or more local area networks (LANs), such as user device devices 116 may communicate with monitoring center 112 through the Internet and/or a LAN on which both monitoring center 112 and user devices 116 are included.

Although additional network devices are not shown for ease of explanation, it should be understood that network 115 and system 100 may comprise additional network and/or computing devices such as, for example, one or more additional switches, routers, hubs, gateways, security devices such as firewalls, intrusion detection, and/or intrusion prevention devices, servers, computer terminals, laptops, printers, databases, wireless mobile devices such as cellular phones or personal digital assistants, wireless access points, bridges, cable modems, application accelerators, or other network devices. It should be understood that one or more additional network elements may be included along any of network links 120A-120C, such that the devices of system 100 are not directly coupled. Network links 120A-120C may be wired or wireless communication links, such as 100 Mbps, 1 Gbps, or 10 Gbps WiFi connections and/or physical cable connections, to name only a few examples.

In operation, in order to monitor a released criminal offender, such as monitored person 104A, a law enforcement officer, such as monitoring user 118A, may attach BWTD 106A to the ankle of monitored person 104A. In some examples, BWTD 106A may include a tamper-resistant strap that binds BWTD 106A to monitored person 104A. BWTD 106A may include one or more components comprised of hardware and/or software that detect if either the tamper-resistant strap and/or the housing/internal components of BWTD 106A have been tampered with by a monitored offender or other person. If BWTD 106A detects that tampering is or has occurred, then BWTD 106A may send a message via network 115 to monitoring center 112 to indicate the tampering event.

Upon attaching BWTD 106A to the ankle of monitored person 104A, monitoring user 118A may provide one or more user inputs to user device 116B that define an association between BWTD 106A and monitored person 104A in monitoring center 112. In other words, monitored person 104A may be assigned to wear a particular BWTD 106A. User device 116B, for example, may output for display a graphical user interface. The graphical user interface may include one or more user interface components, such as input fields, dropdown menus, labels or text fields, or any other graphical component through which a user may interact with user device 116B.

In the example of FIG. 1, monitoring user 118A may provide one or more inputs that specify or select a unique identifier of BWTD 106A and may further provide one or more user inputs that specify or select a unique identifier of monitored person 104A. Upon specifying or selecting the unique identifiers of BWTD 106A and/or monitored person 104A, monitoring user 118A may provide one or more user inputs to define an association between the respective unique identifiers. User device 116B may send one or more messages to monitoring center 112 that define in data, the association between the unique identifier of monitored person 104A and BWTD 106B.

In some examples, monitoring user 118A may specify other data in monitoring center 112 that is associated with BWTD 106B and/or monitored person. For instance, monitoring user 118A may provide one or more user inputs at user device 116B that specify restricted areas and/or permitted areas. A permitted area may include a bounded area in which a monitored person must remain if the BWTD is unable to determine GNSS coordinates. Monitoring user 118A may provide one or more user inputs at user device 116B that specify permissible times or distances that a monitored person is allowed to travel or otherwise move about. User device 116B may send one or more messages to monitoring center 112 with the data specified by monitoring user 118A, and monitoring center 112 may configure or associate the data with the unique identifier of monitored person 104A and BWTD 106A.

Upon monitoring user 118A attaching to and configuring BWTD 106A with monitored person 104A, monitored person 104A may be released from custody into the general public (i.e., released from a confined or restricted condition, such as a jail, prison, or courthouse). As monitored person 104A moves throughout a geographic region, such as geographic region 101, BWTD 106A determines respective GNSS locations of BWTD 106A and sends messages to monitoring center 112 that include at least a unique identifier of BWTD 106A and/or monitored person 104A, unique tower identifier, GNSS coordinates (latitude, longitude), and timestamps for when each respective GNSS coordinate has been determined. BWTD 106A may send such messages through wireless communication with tower 110, which in turns sends the messages to monitoring center 112 via network 115, and in some examples one or more additional, intermediate networked devices (not shown in FIG. 1).

In accordance with techniques of this disclosure, in some examples, BWTD 106A may be unable to determine a current geospatial location of BWTD 106A. For example, monitored person 104A may enter a building such that BWTD 106A may lose a connection to one or more of satellites 108, thus losing a GNSS signal. In some examples, rather than requiring monitored person 104A to go outside so that BWTD 106A can reacquire a GNSS signal, BWTD 106A determines a net distance of BWTD 106A between the current location of BWTD 106A and a previous, known location of BWTD 106A (e.g., the last known location before BWTD 106A is no longer connected to a threshold number of GNSS satellites 108 used to determine the current GNSS coordinates). In some scenarios, the net distance is the straight-line distance between a first (e.g., starting) location and a second (e.g., ending or subsequent) location of a traveled path, rather than the actual length or distance traveled path. For instance, if BWTD 106A loses a GNSS signal when monitored person 104A enters his or her home, monitored person 104A may actually travel a large distance throughout his or her home but the net distance between the first location (e.g. the last known location outside the home before losing a GNSS signal) and a subsequent location (e.g., a location within the home) may be relatively small.

In some examples, BWTD 106A determines the net distance based on data generated by one or more motion sensors. In the example of FIG. 1, BWTD 106A detects a plurality of steps based on acceleration data generated by an accelerometer. For each step of the plurality of steps, BWTD 106A determines a direction of travel of monitored person 104A and BWTD 106A. In some instances, the gyroscope of BWTD 106A detects the rate of change in the orientation of BWTD 106A during each step in the plurality of steps, and integrates the rate of change in the orientation to determine the change in orientation for each step in the plurality of steps. BWTD 106A also estimates the distance traveled during each step (e.g., based on the acceleration data generated by the accelerometer or based on a predetermined estimate of a stride length stored in memory). Thus, for each step in the plurality of steps, BWTD 106A determines the estimated distance traveled and the direction of travel. BWTD 106A aggregates the distance traveled and direction of travel for the plurality of steps to determine a net distance of the BWTD 106A between the last known location and the current location of BWTD 106A. As illustrated by graphical user interface 124 of FIG. 1, bounded area 125 is a circle surrounding the last known location 126 of BWTD 106A. BWTD 106A may estimate that BWTD 106A is a net distance D from the last known location 126 of BWTD 106A.

In some examples, BWTD 106A determines whether BWTD 106A is within a bounded area that includes the last known location of BWTD 106A based on the net distance between the last known location and the current location of BWTD 106A. For example, BWTD 106A may determine whether BWTD 106A is within a boundary surrounding the last known location of BWTD 106A. The boundary surrounding the last known location of BWTD 106A may include a regular shape (e.g., a circle, square, etc.) or an irregular shape. In some examples, the shape is centered on the last known location of BWTD 106. Regular shapes include circles and shapes with equal sides and equal angles between the equal sides (e.g., a square, a regular hexagon, etc.). Irregular shapes include any shape that is not a regular shape.

In some instances, BWTD 106A determines whether BWTD 106A is within the bounded area by determining whether the net distance satisfies a threshold distance. For instance, as illustrated in FIG. 1, the threshold distance may be the radius R of bounded area 125. BWTD 106A may determine whether the net distance D satisfies the threshold distance by determining whether the net distance is less than or equal to the radius R of the bounded area. In an example where the net distance is equal to 3.0 meters even though the total distance covered by the plurality of steps equals 100 meters (e.g., monitored person 104A was pacing back and forth) and the threshold distance equals 10 meters, BWTD 106A determines that BWTD 106A is within the bounded area because the net distance satisfies (e.g., is less than or equal to) the threshold distance. However, in an example where the net distance equals 15 meters and the threshold distance equals 10 meters, BWTD 106A determines that BWTD 106A is not within the bounded area.

BWTD 106A may determine whether BWTD 106A is within the bounded area based on the net distance and a net direction between the last known location of BWTD 106A and the current location of BWTD 106A. For example, the bounded area may include a shape other than a circle (e.g., a rectangle) and monitored person 104A may be permitted to travel further in one direction (e.g., North) relative to a different direction (e.g., East). In some scenarios, BWTD 106A may determine that BWTD 106A is currently at location 127 based on the net distance and the net direction of travel. In these scenarios, BWTD 106A may determine whether BWTD 106A is within the bounded area based on the net distance and the net direction.

In some examples, in response to determining that BWTD 106A is within the bounded area, BWTD 106A may temporarily disable the GNSS components of BWTD 106A. In some examples, BWTD 106A may reduce the polling interval of the GNSS components in response to determining that BWTD 106A remains within the bounded area. In other words, BWTD 106A may reduce how often GNSS components attempt to communicate with satellites 108. Disabling or reducing the polling interval of the GNSS components while the BWTD 106A is within the bounded area may increase the battery life of BWTD 106A.

In response to determining that BWTD 106A is not within the bounded area, BWTD 106A outputs a notification that BWTD 106A is not within the bounded area. In some examples, BWTD 106A sends a message to monitoring center 112 indicating BWTD 106A is not within the bounded area and/or sends a message to a computing device (e.g., a cell phone) associated with monitored person 104A). In some instances, BWTD 106A sends a message to monitored person's 104A cell phone indicating that the BWTD 106A is not within the bounded area that includes the last known location of BWTD 106A and that monitored person 104A should return inside the bounded area and/or find a place where BWTD 106A may reacquire a GNSS signal. In some examples, BWTD 106A outputs an alert (e.g., haptic, visual, or audible) indicating the BWTD 106A is not within the bounded area.

While BWTD 106A is described as determining whether BWTD 106A is within the bounded area that includes the first location, in some examples, BWTD 106A may send processed data (e.g., the net distance, or number of steps, estimated distance of each step, and orientation of each step) or unprocessed data (e.g., data generated by the accelerometer and gyroscope) to monitoring center 112. In such examples, monitoring center 112 determines whether BWTD 106A is within the bounded area that includes the last known location of BWTD 106A. For instance, if the bounded area includes an irregular shape, monitoring center 112 may determine whether BWTD 106A is within the bounded area because monitoring center 112 may include more processing power than BWTD 106A.

According to some aspects, monitoring center 112 performs at least one operation in response to determining that BWTD 106A is not within the bounded area that includes the last known location of monitored person 104A. For example, as noted above, monitoring center 112 may send a notification via network 115 to the BWTD for the violation, which may cause the BWTD to output an alert (e.g., haptic, visual, and/or audio feedback). In other examples, monitoring center 112 may send notifications to one or more other users, who may be associated with the monitored person who is in violation. For instance, monitoring center 112 may generate and transmit GUI 124 for transmission to and display by one or more of user devices 116. In some examples, GUI 124A indicates the bounded area 125, the last known location of BWTD 106A 126, an estimated location 127 of BWTD 106A, or a combination therein.

While techniques of this disclosure have been described in the context of determining net distance of BWTD 106A after losing a GNSS signal, the techniques described herein may be applied in other scenarios. For example, a BWTD may not include GNSS component and may determine the net distance between a current location of the BWTD 106A and a previous, known position of BWTD 106A. For instance, BWTD 106A may determine a first location of a BWTD 106A based on data received by a communication component (e.g., based on an IP address or information from a cellular radio). In response to determining the net distance of BWTD 106A, BWTD 106A may determine whether BWTD 106A is within a bounded area that includes the last known area of BWTD 106A or may output the net distance to monitoring center 112, which may determine whether BWTD 106A is within the bounded area that includes the last known location of BWTD 106A.

In this way, the techniques of this disclosure may enable a BWTD to determine a net distance between a previous location (e.g., the last known location) and a current location of the BWTD. By determining the net distance between two locations, the BWTD and/or monitoring center may determine whether the BWTD is within a bounded area that includes the last known location of the BWTD. Rather than generating an alert when the BWTD does not have a GNSS signal, the techniques of this disclosure may reduce the number of alerts generated by outputting alerts only when the BWTD and/or monitoring center determines the BWTD is not within a permissible area. Reducing the number of alerts may reduce the frequency of data transfers and amount of data transferred between the BWTD and the monitoring center, which may increase battery life of the BWTD and may decrease network traffic. Reducing the number of alerts may also reduce the time and resources consumed by law enforcement administrators in supervising monitored persons. Reducing the number of alerts may ease the burden on monitored persons by reducing how often the BWTD needs to reacquire a GNSS signal.

Figure 2:
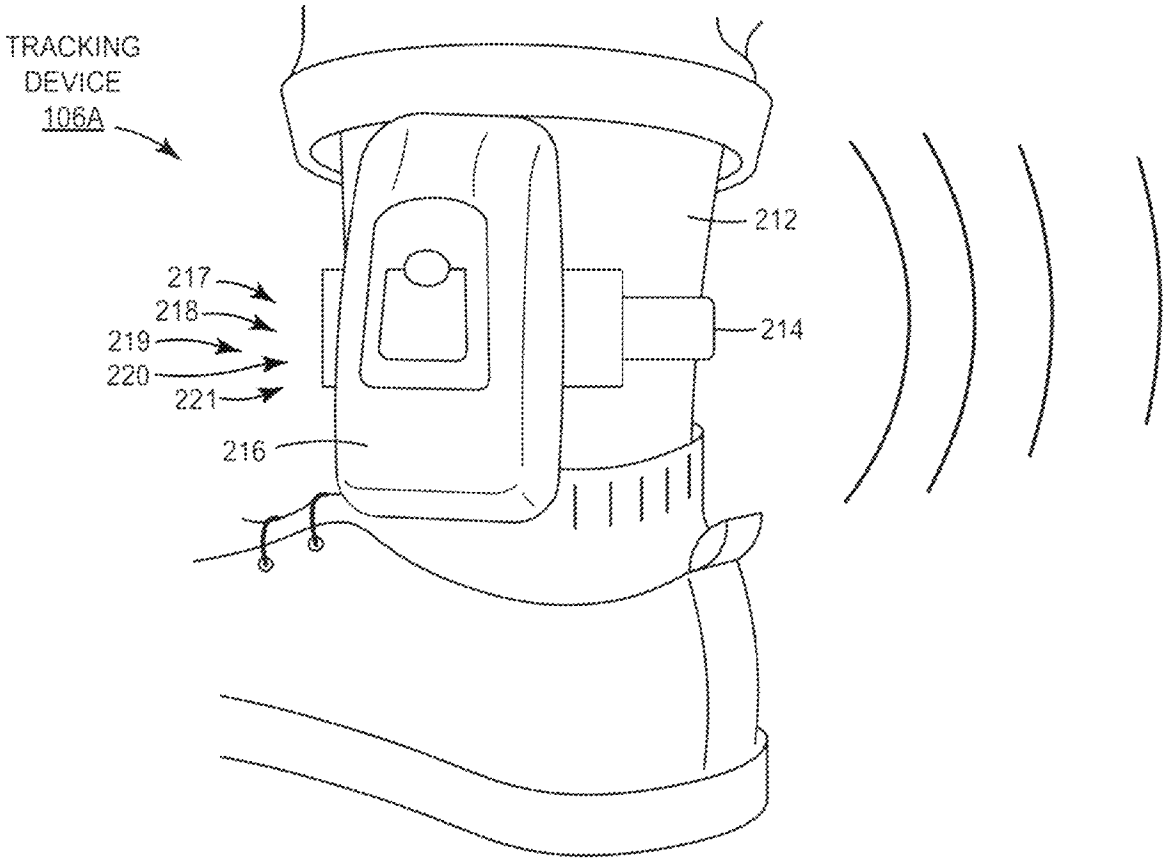
FIG. 2 is a perspective view of an example tracking device, in accordance with one or more aspects of the present disclosure.

FIG. 2 is a perspective view of an example tracking device device, in accordance with one or more aspects of the present disclosure. FIG. 2 illustrates only one particular example of BWTD 106A, as shown in FIG. 1. Many other examples of BWTD 106A may be used in other instances and may include a subset of the components included in example BWTD 106A or may include additional components not shown in FIG. 2. As illustrated in FIG. 2, BWTD 106A may be attached to an ankle 212 of a monitored person 104A assigned to wear BWTD 106A. In some examples, BWTD 106A includes strap 214 and housing 216.

Housing 216 includes or contains a variety of components such as one or more processors 217, one or more storage components 218, one or more GNSS components 219, one or more motion sensors 220, and one or more communication units 221 for communicating wirelessly with an external device.

One or more processors 217 may implement functionality and/or execute instructions within BWTD 106A. For example, processors 217 on BWTD 106A may receive and execute instructions stored by storage components 218 to perform one or more operations in accordance with techniques of this disclosure. The instructions, when executed by processors 217, may cause processors 217 to store information within storage components 218.

Storage components 218 may include volatile memory and/or non-volatile memory. Examples of volatile memories include random access memories (RAM), dynamic random access memories (DRAM), static random access memories (SRAM), and other forms of volatile memories known in the art. Storage components may be configured for long-term storage of information as non-volatile memory space and retain information after power on/off cycles. Examples of non-volatile memories include magnetic hard discs, optical discs, floppy discs, flash memories, or forms of electrically programmable memories (EPROM) or electrically erasable and programmable (EEPROM) memories.

GNSS components 219 may enable BWTD 106A to determine the location of BWTD 106A at any given time. For example, GNSS components 219 may include hardware (e.g., GPS receiver) that receives satellite signals (e.g., data from satellites 108 of FIG. 1, such as the location of each satellite 108 and the time the location was sent) to determine the current location of BWTD 106A at a particular time.

Motion sensors 220 may include at least one of a variety of sensors, including an accelerometer, a gyroscope, a piezoelectric vibration sensor, a magnetometer, a magnetic switch, or any combination therein. Motion sensors 220 can be configured to measure a signal (e.g., acceleration of BWTD 106A, orientation of BWTD 106A, etc.) related to movement of the person during a time window.

In some examples, GNSS components 219 may lose a connection to a GNSS satellite such that BWTD 106A may not be able to determine the coordinates of BWTD 106A. In other words, if GNSS components are not communicatively coupled to sufficient (e.g., three) satellites, processors 217 may determine that a current location of BWTD 106A cannot be determined using the GNSS components. Responsive to determining that the current location of BWTD 106A cannot be determined using the GNSS components 219, processors 217 may determine a net distance from the last known location of BWTD 106A based on data generated by motion sensors 220. For instance, processors 217 may detect a plurality of steps based on acceleration data from the accelerometer. Processors 217 may estimate a distance of each step (e.g., based on a predetermined step or stride length) and direction of each step. Processors 217 may determine the direction of each step based at least in part on the data generated by the gyroscope. Processors 217 may determine a net distance from the last known location of BWTD 106A to the current location of BWTD 106A based on the distance and direction of each step in the plurality of steps. In some examples, processors 217 determine whether the net distance satisfies (e.g., is less than or equal to) a threshold distance. In some examples, processors 217 may determine that BWTD 106A is outside the permissible bounded area in response to determining that the net distance docs not satisfy the threshold distance.

Communication units 221 may send and/or receive data from another computing device (e.g., server devices 114 of FIG. 1). For instance, communication units 221 may send an indication of whether the BWTD 106A is within the permissible bounded area to server devices 114. Responsive to determining that the BWTD 106A is not within the bounded area, communication units 221 may send a message to server devices 114 of FIG. 1 indicating BWTD 106A is not within the permissible bounded area, such that server devices 114 may generate an alert (e.g., to a law enforcement officer or a person assigned to wear BWTD 106A). For instance, server devices 114 may send an alert to the user assigned to wear BWTD 106A indicating that the user should proceed to an area where the GNSS communications can be reestablished (e.g., go outside) or to return to the bounded area.

Figure 3:
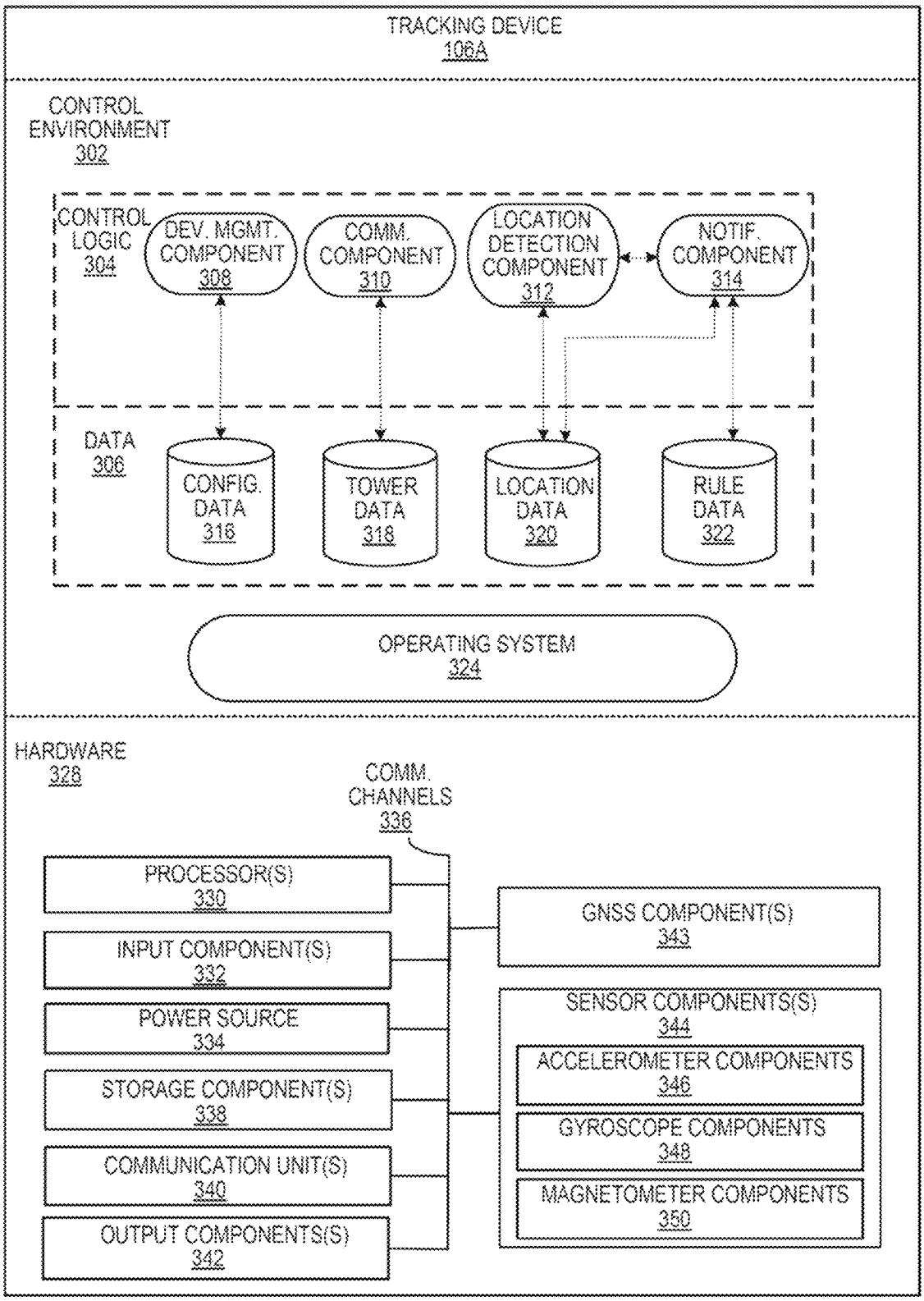
FIG. 3 is a block diagram illustrating an example tracking device, in accordance with one or more aspects of the present disclosure.

FIG. 3 is a block diagram illustrating an example tracking device, in accordance with one or more aspects of the present disclosure. FIG. 3 illustrates only one particular example of BWTD 106A, as shown in FIG. 1. Many other examples of BWTD 106A may be used in other instances and may include a subset of the components included in example BWTD 106A or may include additional components not shown in FIG. 3. In some examples, BWTD 106A may run a set, subset, or superset of functionality included in control logic 304. In some examples, the external housing (not shown) of BWTD 106A may have one or more attachment components (not shown), such as straps, fasteners, magnetic materials, adhesive materials or any other mechanism or material for attaching or associating with tracking device 106A with an object to be tracked.

As shown in the example of FIG. 3, BWTD 106A may be logically divided into control environment 302 and hardware 328. Hardware 328 may include one or more hardware components that provide an operating environment for components executing in control environment 302. Control environment 302 may include operating system 324, which or may not operate with higher privileges than other components executing in control environment 302.

As shown in FIG. 3, hardware 328 includes one or more processors 330, input components 332, power source 334, storage components 338, communication units 340, output components 342, GNSS components 343, and sensor components 344. Processors 330, input components 332, power source 334, storage components 338, communication units 340, output components 342, GNSS components 343, and sensor components 344 may each be interconnected by one or more communication channels 336. Communication channels 336 may interconnect each of the components 330, 332, 334, 338, 340, 342, 343, and 344 for inter-component communications (physically, communicatively, and/or operatively). In some examples, communication channels 336 may include a hardware bus, a network connection, one or more inter-process communication data structures, or any other components for communicating data between hardware and/or software.

One or more processors 330 may implement functionality and/or execute instructions within BWTD 106A. For example, processors 330 on BWTD 106A may receive and execute instructions stored by storage components 338 that provide the functionality of components included in control environment 302. These instructions executed by processors 330 may cause BWTD 106A to store and/or modify information, within storage components 338 during program execution Processors 330 may execute instructions of components in control environment 302 to perform one or more operations in accordance with techniques of this disclosure. That is, components included in user control environment 302 may be operable by processors 330 to perform various functions described herein.

One or more input components 332 of BWTD 106A may receive input. Examples of input are tactile, audio, kinetic, and optical input, to name only a few examples Input components 332 of BWTD 106A, in one example, include a voice responsive system, video camera, buttons, control pad, microphone or any other type of device for detecting input from a human or machine. In some examples, input component 210 may be a presence-sensitive input component, which may include a presence-sensitive screen, touch-sensitive screen, etc.

As shown in FIG. 3, BWTD 106A may include a power source 334. In some examples, power source 334 may be a battery. Power source 334 may provide power to one or more components of BWTD 106A. Examples of power source 334 may include, but are not necessarily limited to, batteries having zinc-carbon, lead-acid, nickel cadmium (NiCd), nickel metal hydride (NiMH), lithium ion (Li-ion), and/or lithium ion polymer (Li-ion polymer) chemistries. In some examples, power source 334 may have a limited capacity (e.g., 1000-3000 mAh).

One or more storage components 338 within BWTD 106A may store information for processing during operation of BWTD 106A. In some examples, storage device 338 is a temporary memory, meaning that a primary purpose of storage device 338 is not long-term storage. Storage components 338 on BWTD 106A may configured for short-term storage of information as volatile memory and therefore not retain stored contents if deactivated Examples of volatile memories include random access memories (RAM), dynamic random access memories (DRAM), static random access memories (SRAM), and other forms of volatile memories known in the art.

Storage components 338, in some examples, also include one or more computer-readable storage media. Storage components 338 may be configured to store larger amounts of information than volatile memory. Storage components 338 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM) memories. Storage components 338 may store program instructions and/or data associated with components included in control environment 302.

One or more output components 342 of BWTD 106A may generate output. Examples of output are tactile, audio, and video output. Output components 342 of BWTD 106A, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output. Output components 342 may be integrated with BWTD 106A in some examples. In other examples, output components 342 may be physically external to and separate from BWTD 106A, but may be operably coupled to BWTD 106A via wired or wireless communication. An output component may be a built-in component of BWTD 106A located within and physically connected to the external packaging of BWTD 106A. In another example, output components 342 may be an external component of BWTD 106A located outside and physically separated from the packaging or housing of BWTD 106A. Output components 342 may provide haptic, vibratory or other tactile output.

One or more communication units 340 of BWTD 106A may communicate with external devices by transmitting and/or receiving data. For example, BWTD 106A may use communication units 340 to transmit and/or receive radio signals on a radio network such as a cellular radio network. Examples of communication units 340 include a network interface card (e.g. such as an Ethernet card), an optical transceiver, a radio frequency transceiver, or any other type of device that can send and/or receive information. Other examples of communication units 340 may include Bluetooth®, 3G, 4G, and Wi-Fi® radios found in mobile devices as well as Universal Serial Bus (USB) controllers and the like.

GNSS components 343 may transmit and/or receive satellite signals on a satellite network (e.g., the GPS network or other government or commercially operated satellite network). GNSS components 343 may communicate with a plurality of satellites and location detection component 312 may determine coordinates corresponding to the location of BWTD 106A at a particular point in time.

In some examples, sensor components 344 include a plurality of motion sensing components, such as accelerometer components 346 and gyroscope components 348. Accelerometer components 346 may generate data indicative of the acceleration of BWTD 106A in at least one plane. In some examples, accelerometer components 346 include a 3-axis accelerometer that detects acceleration in 3-dimensions and generates data indicative of the acceleration in each of the 3-dimensions. Gyroscope components 348 may generate data indicative of a change in the orientation (e.g., direction) of BWTD 106A in one or more of the 3-dimensions. As illustrated in FIG. 3, sensor components 344 may include magnetometer components 350. Magnetometer components 350 may detect a magnetic field (e.g., earth's magnetic field) and may generate data indicative of the detected magnetic field. Location detection component 312 may determine the orientation of BWTD 106A relative to the magnetic field based on the data generated by magnetometer components 350.

As shown in FIG. 3, control logic 304 executes in control environment 302. Control logic 304 may include but is not limited to: device management component (DMC) 308, communication component 310, location detection component 312, and notification component 314. Data 306 may include one or more datastores. A datastore may store data in structure or unstructured form. Example datastores may be any one or more of a relational database management system, online analytical processing database, table, or any other suitable structure for storing data.

Configuration data 316 may include one or more of: a unique identifier of BWTD 106A, a unique identifier of the monitored person to which BWTD 106A is assigned, and/or any other properties or parameters that control or change the operation of tracking device 106A. Tower data 318 may include records, tuples or sets, wherein each record, tuple or set specifies one or more of: a unique identifier of a particular tower, a latitude and longitude of BWTD 106A when BWTD 106A detected or initiated a communication session with the particular tower, a signal strength for the tower when BWTD 106A detected or initiated a communication session with the particular tower, a directional heading of BWTD 106A when BWTD 106A detected or initiated a communication session with the particular tower, and/or a timestamp when BWTD 106A detected or initiated a communication session with the particular tower.

Data 306 may include location data 320. Location data 320 may include records, tuples or sets, wherein each record, tuple or set specifies one or more of: a unique identifier of BWTD 106A and/or monitored person wearing BWTD 106A, GNSS coordinates (latitude, longitude), a timestamp when the GNSS coordinates (latitude, longitude) were determined, GNSS signal strength when the GNSS coordinates (latitude, longitude) were determined, signal strength of a tower when the GNSS coordinates (latitude, longitude) were determined, and/or a directional heading of BWTD 106A when the GNSS coordinates (latitude, longitude) were determined.

Rule data 322 may include data that defines, one or more of: a restricted area, a permissible area, a time period for permitted travel with respect to a restricted/permissible area, permissible/restricted users who can or cannot be within a threshold distance of the monitored person, or any other property, rule, condition, to name only a few examples. In some examples, rule data 322 may include data that defines the boundary of a restricted or permitted area. For instance, rule data 322 may specify a threshold displacement within which the person assigned to wear BWTD 106A is permitted to travel if BWTD 106A loses a GPS signal (e.g., such that the current location of the BWTD 106A cannot be determined based on data received by the GNSS components). In other words, in some instances, the person assigned to wear BWTD 106A may be permitted to travel in any direction (e.g., within a circle) so long as the net distance from the last known location of BWTD 106A is less than (or less than or equal to) a threshold displacement. In some instances, rule data 322 may specify coordinates indicating the boundary of a permitted area (e.g., four coordinates may specify the corners of a rectangular building) associated with the last known location of BWTD 106A. In other words, as one example, if the last known location of BWTD 106A corresponds to the user's place of employment, rule data 322 may include the coordinates of the corners of the building (or property line) in which the user works.

In operation, DMC 308 may initially be configured with configuration data 316. For instance, DMC 308 may be programmed, from an external computing device, with a unique identifier for BWTD 106A and/or a unique identifier of the monitored person associated with or assigned to BWTD 106A. Once BWTD 106A has been configured with configuration data 316, the monitored person may move about one or more geographic regions.

Communication component 310 may initiate, manage, and terminate communication sessions with towers that provide cellular network infrastructure. In particular, as BWTD 106A moves to different geographic regions, communication component 310 may initiate communication sessions with different towers in the different regions. In this way, communication component 310 maintains communication between BWTD 106A and monitoring center 112.

Location detection component 312 may determine the location (e.g., GPS coordinates) of BWTD 106A based on data received from GNSS components 343. For instance, GNSS components 343 may receive global position signals from a plurality of GNSS satellites (e.g., satellites 108 in FIG. 1). The global positioning signals received from each GNSS satellite may include data indicating the position of a respective GNSS satellite and the time at which the GNSS signal was sent). Location detection component 312 may determine the latitude and longitude of BWTD 106A at a particular point time based on the data received from the GNSS satellites. Location detection component 312 may determine the latitude and longitude on a periodic basis according to an interval that may be included in configuration data 316. The time interval may be programmed by a user, dynamically changed (e.g., based on one or more detected or determined events) or hard-coded. At a point in time (e.g., when a time interval has elapsed), upon determining the latitude and longitude, location detection component 312 may generate and store a record, tuple or set that specifies one or more of: a unique identifier of BWTD 106A and/or monitored person wearing BWTD 106A, GNSS coordinates (latitude, longitude), a timestamp when the GNSS coordinates (latitude, longitude) were determined, GNSS signal strength when the GNSS coordinates (latitude, longitude) were determined, signal strength of a tower when the GNSS coordinates (latitude, longitude) were determined, and/or a directional heading of BWTD 106A when the GNSS coordinates (latitude, longitude) were determined. Location detection component 312 may send location data 320 to monitoring center 112 of FIG. 1 in real-time, periodically, or asynchronously.

According to aspects of this disclosure, location detection component 312 may be unable to determine the current location of BWTD 106A. For example, GNSS components 343 may lose a connection to one or more satellites 108 of FIG. 1 such that location detection component 312 may not be able to determine the geospatial location (e.g., GNSS coordinates) of BWTD 106A. For instance, GNSS components 343 may be unable to connect to one or more GNSS satellites upon entering a building or entering a geographical area obstructed by manmade or naturally occurring environmental features.

Responsive to determining that the GNSS coordinates cannot be determined (e.g., because GNSS components 343 are not communicatively coupled to enough GNSS satellites), location detection components 312 may determine whether BWTD 106A is within a bounded area that includes the last known location of BWTD 106A. In some examples, location detection components 312 determine whether BWTD 106A is within the bounded area that includes the last known location of BWTD 106A based at least in part on the net distance between the last known location of BWTD 106A and the current location of BWTD 106A.

In some instances, location detection component 312 determines the net distance based on motion data generated by one or more sensor components 344. In some examples, sensor components 344 may generate motion data in response to determining that the GNSS coordinates of BWTD 106A are not available. In some scenarios, sensor components 344 may generate the motion data continuously and may store the motion data for a predetermined amount of time (e.g., 1 minute, 5 minutes, 1 hour, etc.) in storage components 338. In such scenarios, location detection component 312 may retrieve the motion data stored between the current time and the time corresponding to the last known location of BWTD 106A for determining the net distance.

The motion data may include acceleration data generated by acceleration components 346 and orientation data generated by gyroscope components 348. In some examples, location detection component 312 receives the acceleration data and detects a plurality of steps based on the received acceleration data. For example, as described in more detail with respect to FIG. 5, location detection component 312 may compare the acceleration data to a template waveform or acceleration pattern and may determine that a portion of the acceleration data corresponds to one or more steps or strides of a person wearing BWTD 106A if a portion of the acceleration data corresponds to the shape of the template acceleration pattern.

Location detection component 312 may determine a direction of travel of BWTD 106A, and hence the monitored person assigned to wear BWTD 106A, for each step in the plurality of steps. In some examples, location detection component 312 determines the direction of travel of BWTD 106A for each step based on the orientation data generated by gyroscope components 348. For example, the orientation data may specify the rate of change of the orientation of BWTD 106A, and location detection component 312 may integrate the rate of change over each step to determine the change in orientation of BWTD 106A for each step in the plurality of steps.

In some examples, location detection component may determine the direction of travel of each step based at least in part on magnetometer data generated by magnetometer components 350. For instance, location detection component may calibrate the orientation data by filtering the orientation data based on the magnetometer data. By calibrating the orientation data based on the magnetometer data, location detection component 312 may more accurately determine the direction of each step in the plurality of steps.

In some scenarios, location detection component 312 may determine the direction of travel of BWTD 106A based on the magnetometer data. For instance, location detection component 312 may determine the oriental on of BWTD 106A relative to earth's magnetic north pole based on the magnetometer data, such that location detection component 312 may determine the direction of travel based on the orientation of BWTD 106A. In some instances, BWTD 106A may calibrate the magnetometer data based on the orientation data generated by the gyroscope components 348.

Location detection component 312 also determines the distance traveled during each step or stride. For example, storage components 338 may store an estimate of the walking stride length, running stride length, or a combination therein and location detection component 312 may determine the estimated stride length by retrieving the stride length from storage components 338. In some examples, the estimated stride length may include a customized estimate of the stride length of the person assigned to wear BWTD 106A. For example, during a time when location detection component 312 is able to determine the GNSS coordinates of BWTD 106A, location detection component 312 may calibrate the stride length by detecting a plurality of steps, determining the overall distance traveled based on data from GNSS components 343, and dividing the overall distance by the number of steps in the plurality of steps. For instance, when monitoring user 118A attaches BWTD 106A to monitored person 104A, location detection component 312 may perform a calibration routine to determine a walking stride length and/or running stride length and may store the stride lengths in storage components 338.

Responsive to determining the distance traveled during each step and determining the direction of travel of each step in the plurality of steps, location detection component 312 may determine a net distance of BWTD 106A between the current position of BWTD 106A and the last known location of BWTD 106A, and optionally, a net direction from the last known location of BWTD 106A. In some examples, location detection component 312 combines the distance and direction of step in the plurality of steps to determine the net distance, and optionally the net direction, between the current location of BWTD 106A and the last known location of BWTD 106A.

Location detection component 312 determines whether BWTD 106A is within a bounded area that includes the last known location of BWTD 106A based on the net distance between the last known location and the current location of BWTD 106A. In some scenarios, the bounded area that includes the last known location includes a circle centered at the last known location of BWTD 106A and the radius of the circle is a threshold distance that the person assigned to wear BWTD 106A is permitted to travel within. In these scenarios, location detection component 312 determines whether BWTD 106A is within the bounded area by comparing the net distance to the threshold distance. In response to determining that the net distance satisfies (e.g., is less than) the threshold distance, location detection component 312 may determine that the BWTD 106A is within the bounded area. However, location detection component 312 may determine that BWTD 106A is not within the bounded area in response to determining that the net distance does not satisfy (e.g., greater than) the threshold distance.

In some examples, location detection component 312 determines whether BWTD 106A is within the bounded area that includes the last known location of BWTD 106A based on the net distance and the net direction between the current location of BWTD 106A and the last known location of BWTD 106A. For example, when BWTD 106A loses a connection to a GNSS satellite such that BWTD 106A is unable to determine its location from the GNSS signals, the person assigned to wear BWTD 106A may be permitted to travel in a non-circular area surrounding the last known location of BWTD 106A. For instance, the last known location of BWTD 106A may correspond to a place of employment for the person assigned to wear BWTD 106A and the person assigned to wear BWTD 106A may be permitted to travel throughout the building in which he or she works. As described in more detail with reference to FIG. 5, the person assigned to wear BWTD 106A may be permitted to travel a first distance in one direction (e.g., North) from the last known location of BWTD 106A and may be permitted to travel a second, different (e.g., larger) distance, in a second direction (e.g., East) Location detection component 312 may determine whether BWTD 106A is within the permitted bounded area by comparing the net distance and the net direction to the permitted bounded area. As another example, location detection component 312 may retrieve GNSS coordinates that define the bounded area from rule data 322 and determine, based on the last known location of BWTD 106, the net distance, and the net direction, whether the current location of BWTD 106A lies within the bounded area defined by the retrieved coordinates.

Responsive to determining that BWTD 106A is not within the bounded area, notification component 314 may output an indication that the BWTD 106A is not within the bounded area. In some examples, notification component 314 may generate and send notifications (e.g., via communication components 310) to one or more external computing devices such as monitoring center 112 and/or user devices 116 of FIG. 1. For example, the notification may include a message indicating that BWTD 106A does not have a GNSS connection and/or that BWTD 106A is no longer within the permissible bounded area. In some scenarios, notification component 314 may output the indication that BWTD 106A is not within the bounded area by sending a command to one or more of output components to output an alert. Responsive to receiving the command to output an alert, one or more of output components 342 may output an alert (e.g., haptic, audio, or visual feedback) that indicates the person wearing BWTD 106A should proceed to an area where the GNSS signal can be reestablished or return to the bounded area.

While BWTD 106A is described as determining whether BWTD 106A is within the bounded area, in some examples and as described in reference to FIG. 4, a server device may receive information from BWTD 106A (e.g., motion data generated by sensor components 344 or the net distance determined by location detection component 312) and may determine whether BWTD 106A is within the bounded area.

FIG. 4 is a block diagram illustrating an example computing device, in accordance with one or more aspects of the present disclosure. FIG. 4 illustrates only one particular example of server device 114A in monitoring center 112, as shown in FIG. 1. Many other examples of server device 114A may be used in other instances and may include a subset of the components included in example server device 114A or may include additional components not shown in FIG. 4. In some examples, server device 114A may be a server, tablet computing device, smartphone, wrist- or head-worn computing device, laptop, desktop computing device, or any other computing device that may run a set, subset, or superset of functionality included in application 428.

As shown in the example of FIG. 4, server device 114A may be logically divided into user space 402, kernel space 404, and hardware 406. Hardware 406 may include one or more hardware components that provide an operating environment for components executing in user space 402 and kernel space 404. User space 402 and kernel space 404 may represent different sections or segmentations of memory, where kernel space 404 provides higher privileges to processes and threads than user space 402. For instance, kernel space 404 may include operating system 420, which operates with higher privileges than components executing in user space 402.

As shown in FIG. 4, hardware 406 includes one or more processors 408, input components 410, storage components 412, communication units 414, and output components 416. Processors 408, input components 410, storage components 412, communication units 414, and output components 416 may each be interconnected by one or more communication channels 418. Communication channels 418 may interconnect each of the components 408, 410, 412, 414, and 416 for inter-component communications (physically, communicatively, and/or operatively). In some examples, communication channels 418 may include a hardware bus, a network connection, one or more inter-process communication data structures, or any other components for communicating data between hardware and/or software.

One or more processors 408 may implement functionality and/or execute instructions within server device 114A. For example, processors 408 on server device 114A may receive and execute instructions stored by storage components 412 that provide the functionality of components included in kernel space 404 and user space 402. These instructions executed by processors 408 may cause server device 114A to store and/or modify information, within storage components 412 during program execution. Processors 408 may execute instructions of components in kernel space 404 and user space 402 to perform one or more operations in accordance with techniques of this disclosure. That is, components included in user space 402 and kernel space 404 may be operable by processors 408 to perform various functions described herein.

One or more input components 410 of server device 114A may receive input. Examples of input are tactile, audio, kinetic, and optical input, to name only a few examples. Input components 410 of server device 114A, in one example, include a mouse, keyboard, voice responsive system, video camera, buttons, control pad, microphone or any other type of device for detecting input from a human or machine. In some examples, input component 410 may be a presence-sensitive input component, which may include a presence-sensitive screen, touch-sensitive screen, etc.

One or more output components 416 of server device 114A may generate output. Examples of output are tactile, audio, and video output. Output components 416 of server device 114A, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output.

Output components 416 may be integrated with server device 114A in some examples. In other examples, output components 416 may be physically external to and separate from server device 114A, but may be operably coupled to server device 114A via wired or wireless communication. An output component may be a built-in component of server device 114A located within and physically connected to the external packaging of server device 114A (e.g., a screen on a mobile phone). In another example, an output component, such as a presence-sensitive screen, may be an external component of server device 114A located outside and physically separated from the packaging of server device 114A (e.g., a monitor, a projector, etc. that shares a wired and/or wireless data path with a tablet computer). Output components 416 may provide haptic, vibratory or other tactile output.

One or more communication units 414 of server device 114A may communicate with external devices by transmitting and/or receiving data. For example, server device 114A may use communication units 414 to transmit and/or receive radio signals on a radio network such as a cellular radio network. Examples of communication units 414 include a network interface card (e.g. such as an Ethernet card), an optical transceiver, a radio frequency transceiver, or any other type of device that can send and/or receive information. Other examples of communication units 414 may include Bluetooth®, 3G, 4G, and Wi-Fi® radios found in mobile devices as well as Universal Serial Bus (USB) controllers and the like.

One or more storage components 412 within server device 114A may store information for processing during operation of server device 114A. In some examples, storage device 412 is a temporary memory, meaning that a primary purpose of storage device 412 is not long-term storage. Storage components 412 on server device 114A may configured for short-term storage of information as volatile memory and therefore not retain stored contents if deactivated. Examples of volatile memories include random access memories (RAM), dynamic random access memories (DRAM), static random access memories (SRAM), and other forms of volatile memories known in the art.

Storage components 412, in some examples, also include one or more computer-readable storage media. Storage components 412 may be configured to store larger amounts of information than volatile memory. Storage components 412 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM) memories. Storage components 412 may store program instructions and/or data associated with components included in user space 402 and/or kernel space 404.

As shown in FIG. 4, application 428 executes in userspace 402 of server device 114A. Application 428 may be logically divided into presentation layer 422, application layer 424, and data layer 426. Presentation layer 422 may include user interface (UI) component 425, which generates and renders user interfaces of application 428. Application layer 424 may include location management component (LMC) 427, rule enforcement component (REC) 429, and notification component 430.

Data layer 426 may include one or more datastores. A datastore may store data in structured or unstructured form. Example datastores may be any one or more of a relational database management system, online analytical processing database, table, or any other suitable structure for storing data. Monitored person data 434 may include information descriptive of monitored persons and/or monitoring users. Example data, may include a unique identifier for a monitored person or user, name, address, phone number, notes, or any other descriptive information of a monitored person or monitored person, such as a type of offense, a degree of offense (e.g., a legal degree of offense, such as second degree battery), or the like.

Location data 436 may include GNSS locations of BWTDs and other data associated with the GNSS locations. For instance, a record or other instance of location data in location data 436 may include, but is not limited to, any one or more of: unique identifier of BWTD and/or monitored person wearing BWTD, timestamp, GNSS coordinates (latitude, longitude), GNSS signal strength, signal strength of cellular tower, and directional heading of BWTD, speed at which a BWTD is traveling, whether a BWTD is at rest, an ambient temperature in which a BWTD is located, whether a BWTD is in motion without a GNSS signal, or the like. The data included in a record or other instance of location data in location data 436 may be a tuple or set of data sent by a BWTD to monitoring center 112, as described in FIG. 1.

Data layer 426 also includes monitoring rules data 438. Monitoring rules data 438 may include data that defines, one or more of: a restricted area, a permissible area, a time period for permitted travel with respect to a restricted/permissible area, permissible/restricted users who can or cannot be within a threshold distance of the monitored person, or any other property, rule, condition, to name only a few examples. In some examples, monitoring rules 438 defines a permissible bounded area that one or more monitored persons are permitted to travel when the BWTD assigned to the respective monitored person is unable to determine its current GNSS coordinates. For example, monitoring rules 438 may include, for one or more monitored persons, a respective threshold distance that the monitored person is permitted to travel when the BWTD assigned to that monitored person is unable to determine its current GNSS coordinates. As another example, monitoring rules 438 may include, for one or more monitored persons, a set of GNSS coordinates that form a bounded area in which the respective monitored person is permitted to travel. Thus, in some examples, monitoring rules 438 may specify one or more bounded areas that are customized to the respective monitored persons. In some instances, the monitoring rules defined by monitoring rules data 438 may be established based on conditions of release or parole of a monitored person. However, the monitoring rules need not be court mandated.

In operation, BWTD 106A may be attached and assigned to monitored person 104A. LMC 427 may receive a unique identifier of BWTD 106A and/or a unique identifier of monitored person 104A. LMC 427 may store data defining an association between the unique identifier of BWTD 106A and the unique identifier of monitored person 104A. As monitored person 104A moves within one or more different geographic regions, LMC 427 may receive location data from BWTD 106A including, but not limited to: a unique identifier of BWTD 106A and/or monitored person wearing BWTD 106A, GNSS coordinates (latitude, longitude), a timestamp when the GNSS coordinates (latitude, longitude) were determined, GNSS signal strength when the GNSS coordinates (latitude, longitude) were determined, signal strength of a tower when the GNSS coordinates (latitude, longitude) were determined, and/or a directional heading of BWTD 106A when the GNSS coordinates (latitude, longitude) were determined. In some scenarios, location data 436 may also include a timestamp when GNSS coordinates of BWTD 106A were not able to be determined and the last known location of BWTD 106A. In these scenarios, location data may also include motion data generated by one or more sensor components 344 of FIG. 3, and/or a net distance and net direction from the last known location of BWTD 106A. LMC 427 may store such location data within location data 436.

REC 429 may determine whether any other property, rule, condition of monitoring rules data 438 is satisfied, and which may include data that defines, one or more of: a restricted area, a permissible area, a time period for permitted travel with respect to a restricted/permissible area, permissible/restricted users who can or cannot be within a threshold distance of the monitored person, or any other property, rule, condition. For instance, REC 429 may determine whether any other property, rule, condition is satisfied based on receiving one or more of GNSS locations from LMC 427, location data 436, and monitoring rules data 438.

While BWTD 106A is described in FIGS. 1-3 as determining whether BWTD 106A is within a bounded area, in some examples, server device 114A may determine whether BWTD 106A is within a bounded area. For example, REC 429 of server device 114A may determine a net distance, net direction, or both between the current location of BWTD 106A and the last known location of BWTD 106A based on motion data received from BWTD 106A. As another example, server device 114A may receive the net distance and/or net direction from BWTD 106A. In either example, REC 429 may determine whether BWTD 106A is within a permissible bounded area when BWTD 106A is unable to determine its GNSS coordinates. Responsive to determining that BWTD 106 is not within the bounded area, REC 429 may cause notification component 430 to send a notification to user devices of one or more monitoring users, and the notification may indicate a violation. Additionally or alternatively, REC 429 may cause notification component to send a notification in response to receiving a message from BWTD 106A that BWTD 106A is not within the bounded area.

Notification component 430 may send notifications (or messages) to computing devices external to server device 114A that cause such computing devices to output alerts, which may be visual, audio, haptic or any other type of discernable feedback. In this way, violations, statuses, or any other information may be communicated to devices of monitored persons and monitoring users. In some examples, events that cause notifications or messages to be sent by notification component 430 may also be logged by LMC 427, REC 429, and/or notification component 430 in monitored person data 434.

In some examples, UI component 425 may act as an intermediary between various components and modules of server device 114A to process and send input detected by input devices to other components and modules, and generate output from other components and modules that may be presented at one or more output devices. For instance, UI component 425 may generate one or more user interfaces for display, which may include data and/or graphical representations of maps, alerts, reports, or other communications as described in this disclosure.

According to aspects of this disclosure, application layer 424 includes boundary adjustment component 432. In general, boundary adjustment component 432 may enable server device 114A to adjust the boundary of an area that the monitored person 104A assigned to wear BWTD 106A is permitted to traverse when BWTD 106A is unable to determine its GNSS coordinates. The updated boundary may correspond to only the first location (e.g., the monitored person's place of employment) or may be a global boundary for all locations (e.g., the location of the monitored person whenever the BWTD loses a GNSS signal).

Figure 5A:
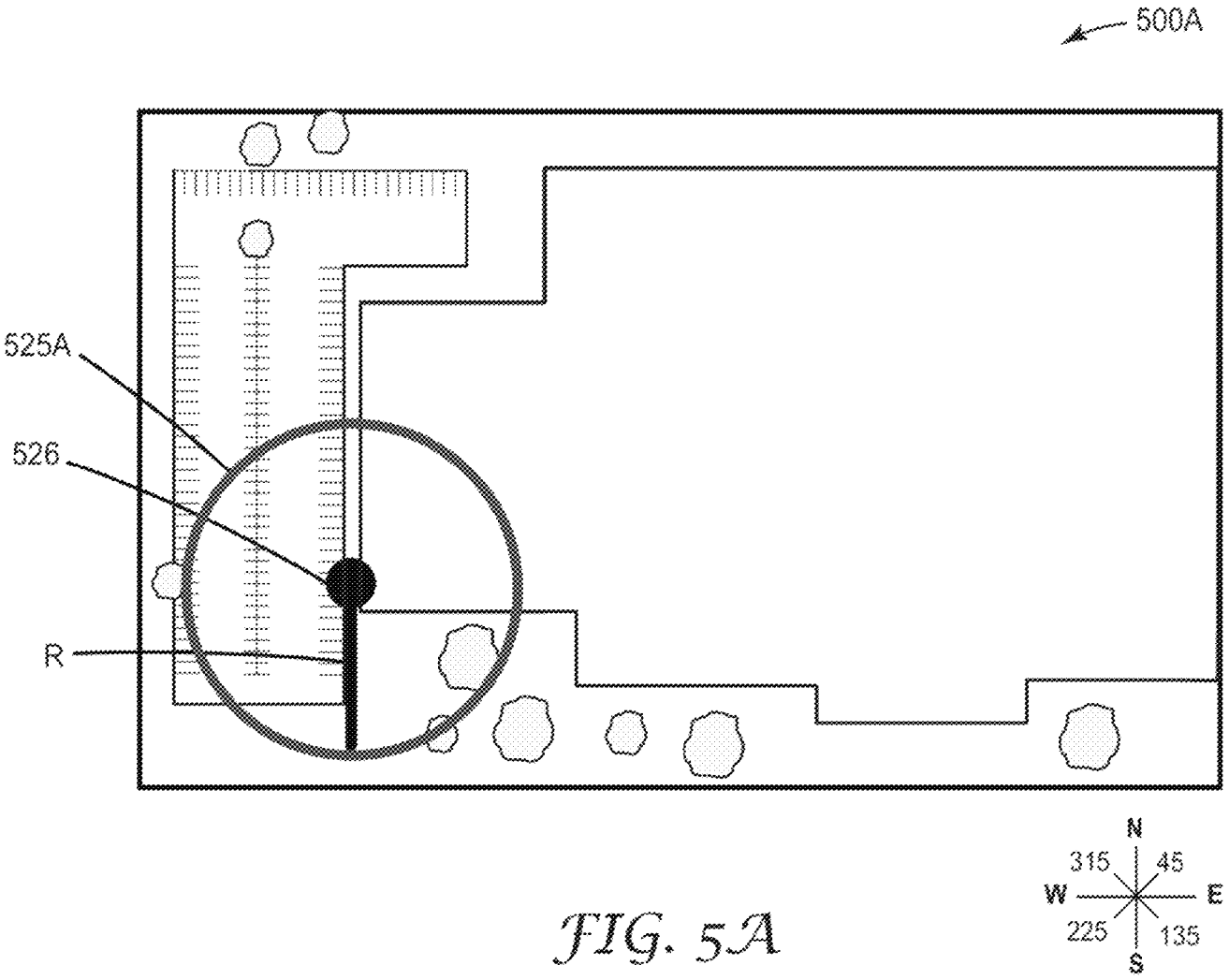
FIGS. 5A-5B are illustrations of example graphical user interfaces generated for display by a computing device, in accordance with techniques of this disclosure.

As described in more detail with reference to FIGS. 5A-5B, boundary adjustment component 432 may send the last known location of BWTD 106A and an indication of the bounded area to UI component 425. UI component may receive the last known location of BWTD 106A and the bounded area and may generate a graphical user interface (GUI) 500A as illustrated in FIG. 5A. For instance, as shown in FIG. 5A, GUI 500A includes an indication of the last known location 526 of BWTD 106A and an initial bounded area 525. UI component 425 may output GUI 500A for display by a display component of output components 416 of server device 114A or a display component of one or more user devices 116.

In some examples, server device 114A may receive an indication of user input adjusting the bounded area. For example, monitoring user 118A may adjust the bounded area by entering a new (e.g., larger) radius D of bounded area via user device 116A. Similarly, monitoring user 118A may adjust the bounded area by selecting and dragging the bounded area to change the size and/or shape of the bounded area. For instance, as illustrated by GUI 500B of FIG. 5B, monitoring user 118A may drag an input device (e.g., a finger, mouse, etc.) over a particular area (e.g., around a building, a property line, etc.) to create an updated bounded area 525B.

In some examples, boundary adjustment component 432 of server device 114A programmatically (e.g., automatically) adjusts the bounded area. Boundary adjustment component 432 may automatically adjust the bounded area based at least in part monitored person data 434 and location data 436. For example, monitored person data 434 may include an address corresponding to a known permitted area. The known permitted area may include the place of employment of monitored person 104A, a church, friend's house, or any other arear that monitored person 104A has permission to enter even when BWTD 106A is unable to determine exact GNSS coordinates. In some instances, monitored person data 434 may specify the work address of monitored person 104A as a permitted area. Boundary adjustment component 432 may determine whether the last known GNSS coordinates of BWTD 106A correspond to the work address of monitored person 104A. Responsive to determining that the last known location of BWTD 106A corresponds to place of employment of monitored person 104A, boundary adjustment component 432 may update the bounded area based on the shape of the building at that address or based on the property lines of that address. For instance, as illustrated in FIG. 5B, the updated bounded area 525B may include all or parts of a building and/or parking lot located at the work address.

Boundary adjustment component 432 may automatically adjust the bounded area based on additional data in data layer 426. For example, monitored person data 434 and/or location data 436 may indicate a compliance level of monitored person 104A (e.g., how many violations has monitored person 104A had in the past, how quickly does monitored person 104A re-establish a GNSS signals when GNSS coverage is lost, or other user history information. For instance, boundary adjustment component 432 may expand the radius of the bounded area (e.g., when the bounded area is a circle) as the monitored person data 434 and location data 436 indicates monitored person 104A is more trustworthy.

In some instances, boundary adjustment component 432 adjusts the bounded area based at least in part on a context of the BWTD. The context may include date/time information, such as the current day of the week, current time of day, etc. For instance, monitored person 104A may be permitted anywhere within his or her place of employment during predetermined days/times. In these instances, boundary adjustment component 432 may update the bounded area to include all of the updated bounded area 525B during the predetermined days/times, but only include the initial bounded area 525A during other days/times.

Responsive to updating the bounded area (e.g., based on user input or automatically), boundary adjustment component 432 may update monitoring rules data 438. Similarly, boundary adjustment component 432 may send an indication of the updated boundary to BWTD 106A via communication units 414. For instance, the indication of the updated boundary may include an updated threshold distance or a set of coordinates that define the boundary of the bounded area. In some examples, BWTD 106A receives the updated bounded area and stores an indication of the updated bounded area within storage components 338. Thus, if BWTD 106A is unable to determine the GNSS coordinates of BWTD 106A at a future time, BWTD 106A may determine whether the BWTD 106A is within the updated bounded area in a similar manner as described above.

Figure 5B:
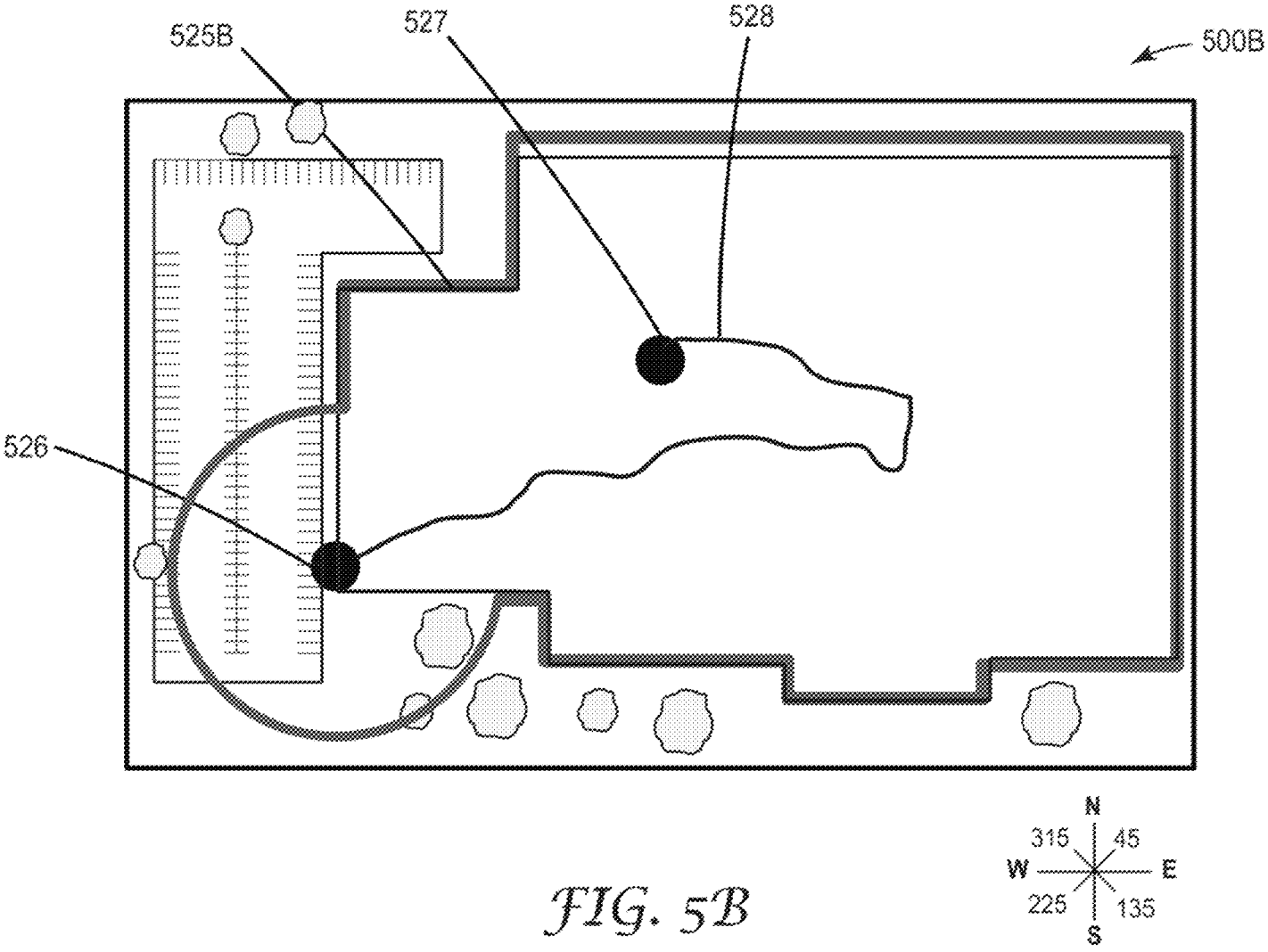

FIGS. 5A-5B are illustrations of example graphical user interfaces generated for display by a computing device, in accordance with techniques of this disclosure. GUI 500A of FIG. 5A illustrates the last known location 526 of monitored person 104A, an initial bounded area 525A that includes the last known location 526, and radius R of bounded area 525A. GUI 500B of FIG. 5B illustrates an updated bounded area 525B, the current location of a monitored person (e.g., monitored person 104A) assigned to wear a BWTD (e.g., BWTD 106A), and a path 528 that includes a plurality of steps between the current location 527 and the last known location 526 of BWTD 106A.

As described in more detail with reference to FIGS. 6A-6B, in some examples, BWTD 106A detects a plurality of steps along path 528 and determines a distance and direction of each step along path 528. BWTD 106A determines whether BWTD 106A is within a bounded area by determining the net distance, and optionally net direction, between the last known location 526 of BWTD 106A and the current location 527 of BWTD 106A. In some examples, BWTD 106A may determine that the net distance from the last known location 526 and the current location 527 of BWTD 106A is 20 meters with a net direction of 45 degrees (e.g., Northeast) from the last known location. In other words, the straight-line distance from the last known location 526 and the current location 527 may be 20 meters, while the actual distance of path 528 may a larger total distance (e.g., 40 meters). In these examples, BWTD 106A may determine that BWTD 106A remains within permitted bounded area 525B. In other examples, BWTD 106A may determine that the net distance from the last known location is 20 meters and that the net direction is 315 degrees (e.g., Northwest) from the last known location, such that BWTD 106A may determine BWTD 106A is not within the bounded area.

Figure 6A:
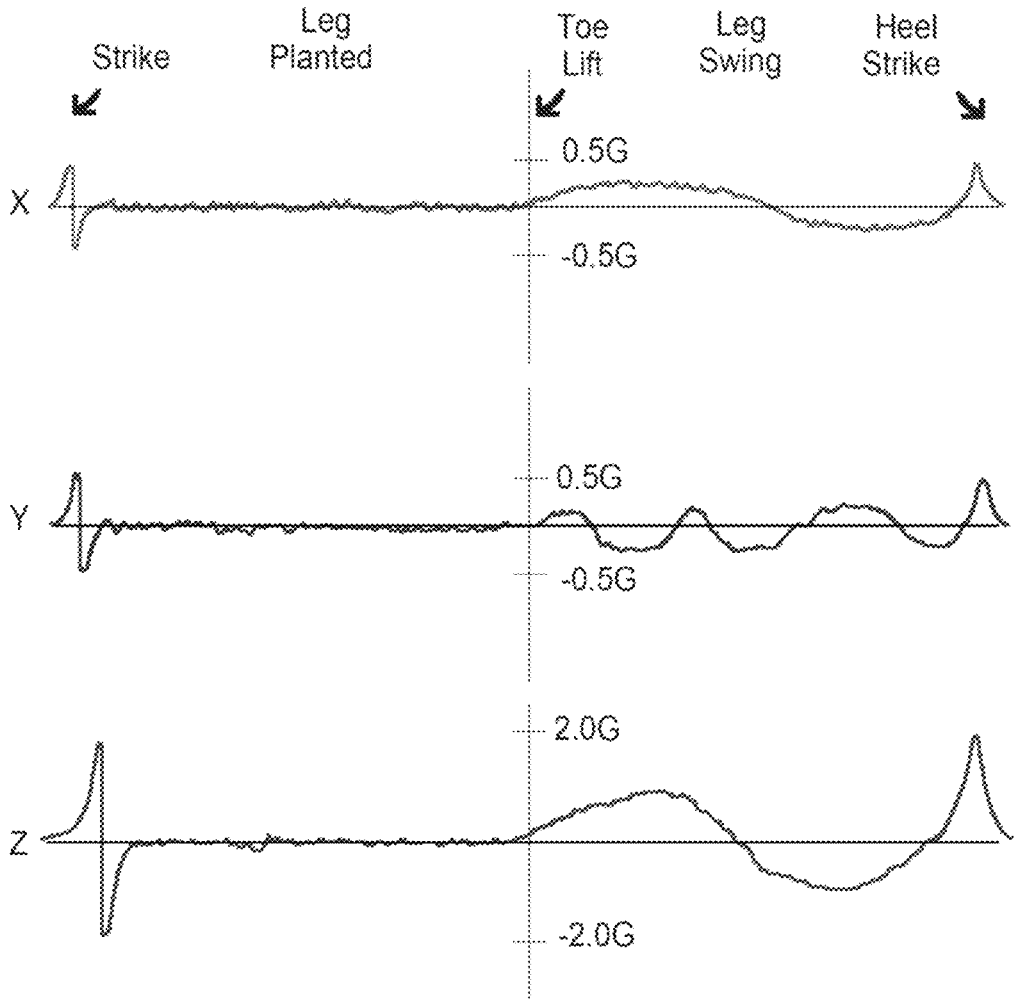
FIGS. 6A-6B are graphs illustrating example motion sensor data, in accordance with techniques of this disclosure.
Figure 6B:
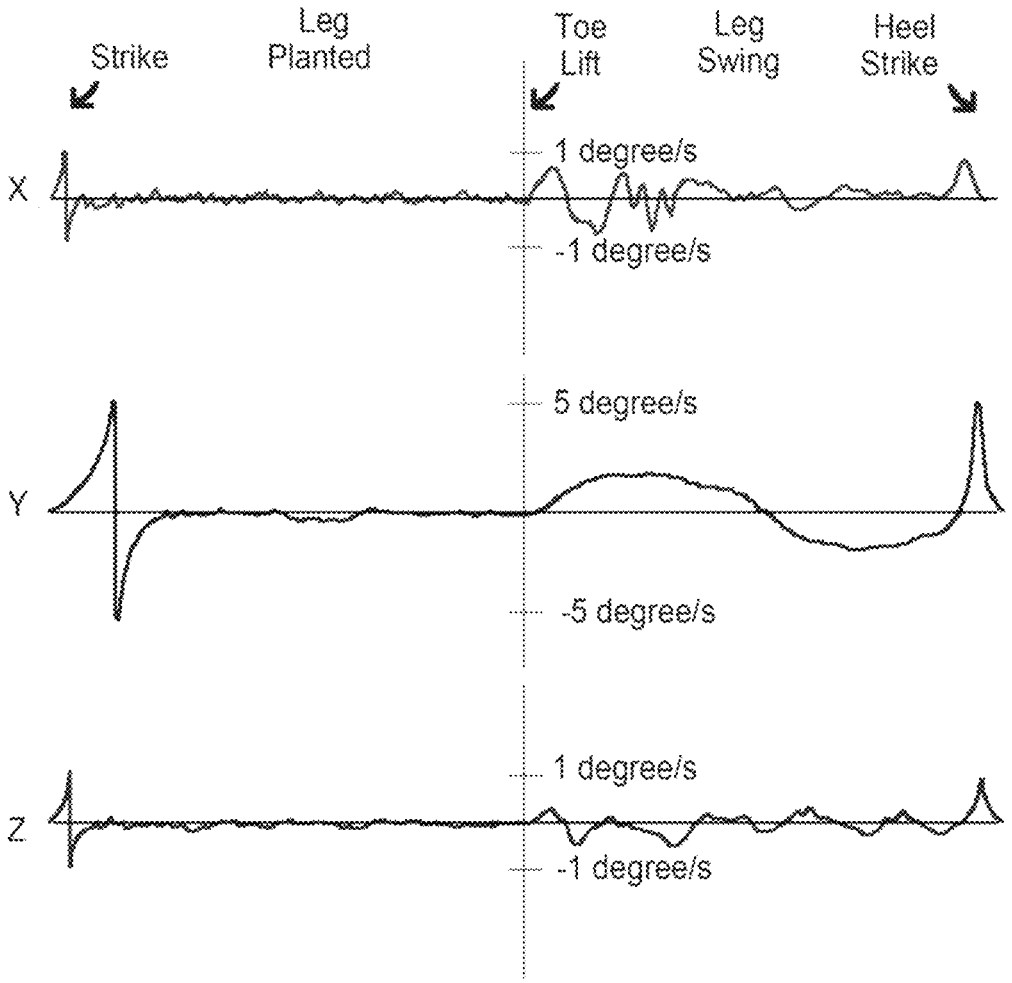

FIGS. 6A-6B are graphs illustrating example motion sensor data, in accordance with techniques of this disclosure. FIG. 6A is an illustration of acceleration data generated by accelerometer components 346. Accelerometer components 346 may measure the acceleration of BWTD 106A in 3-dimensions (x, y, z) when a monitored person 104A wearing BWTD 106A takes a step. During each step, the heel of monitored person strikes the ground, which may be shown by a relatively large, yet brief, acceleration. The heel strike may mark the beginning (or end) of astride. After the heel strikes the ground, the leg of monitored person 104A remains planted for a period of time, which is described as the stance phase. During the stance phase, accelerometer components 346 may detect relatively little (e.g., almost zero) acceleration because the leg is planted on the ground. Then, during a swing phase, the toe of the monitored person lifts off the ground and the swings forward until again striking the ground. Thus, during the swing phase, accelerometer components 346 may detect additional accelerations which may occur over a longer period of time compared to the heel strike.

Location detection component 312 of BWTD 106A may compare the acceleration data measured by acceleration components 346 to a template acceleration pattern. For instance, if the acceleration data generally matches the template acceleration pattern, location detection component 312 may determine that the sequence of heel strike, stance phase, and swing phase corresponds to a step. Location detection component 312 may detect a plurality of steps from the acceleration data by comparing the acceleration data to template acceleration pattern.

FIG. 6B is an illustration of orientation data generated by a gyroscope components 348, in accordance with techniques of this disclosure. Gyroscope components 348 may measure the rate of change in orientation of BWTD 106A in 3-dimensions when a monitored person 104A wearing BWTD 106A takes a step. During a heel strike, the orientation data may show a relatively large and relatively brief change in orientation. The heel strike may be followed by the stance phase, in which the gyroscope components 348 may detect relatively little change in the orientation of BWTD 106A. As the toe lifts of the ground during the swing phase, gyroscope components 348 may again detect changes in the orientation of BWTD 106, which may occur over a longer period of time compared to the heel strike.

Location detection component 312 of BWTD 106A may compare the orientation data generated by gyroscope components 348 to a template orientation pattern. For instance, location detection component may compare the orientation data to the template pattern to detect a sequence that includes a heel strike event, a stance phase, and a swing phase.

By comparing the motion data generated by acceleration—components 346 and gyroscope components 348 to template data patterns, BWTD 106A may determine that the motion data represents a step only when both the acceleration data and the orientation data both match the respective template motion patterns, which may more accurately reflect the number of steps taken by the monitored person 104A assigned to wear BWTD 106A.

In some examples, location detection component 312 may determine whether the person wearing BWTD 106A is walking or running. For example, location detection component may include a first set of template motion patterns for a person that is running and a second set of template motion patterns for a person that is walking. For instance, the acceleration and/or orientation data generated while running may include larger peak values relative to the acceleration and orientation data generated by walking. Thus, location detection component 312 may compare the acceleration data and the orientation data to the respective walking and running templates in order to determine whether the person wearing BWTD 106A is running, walking, or neither.

Figure 7:
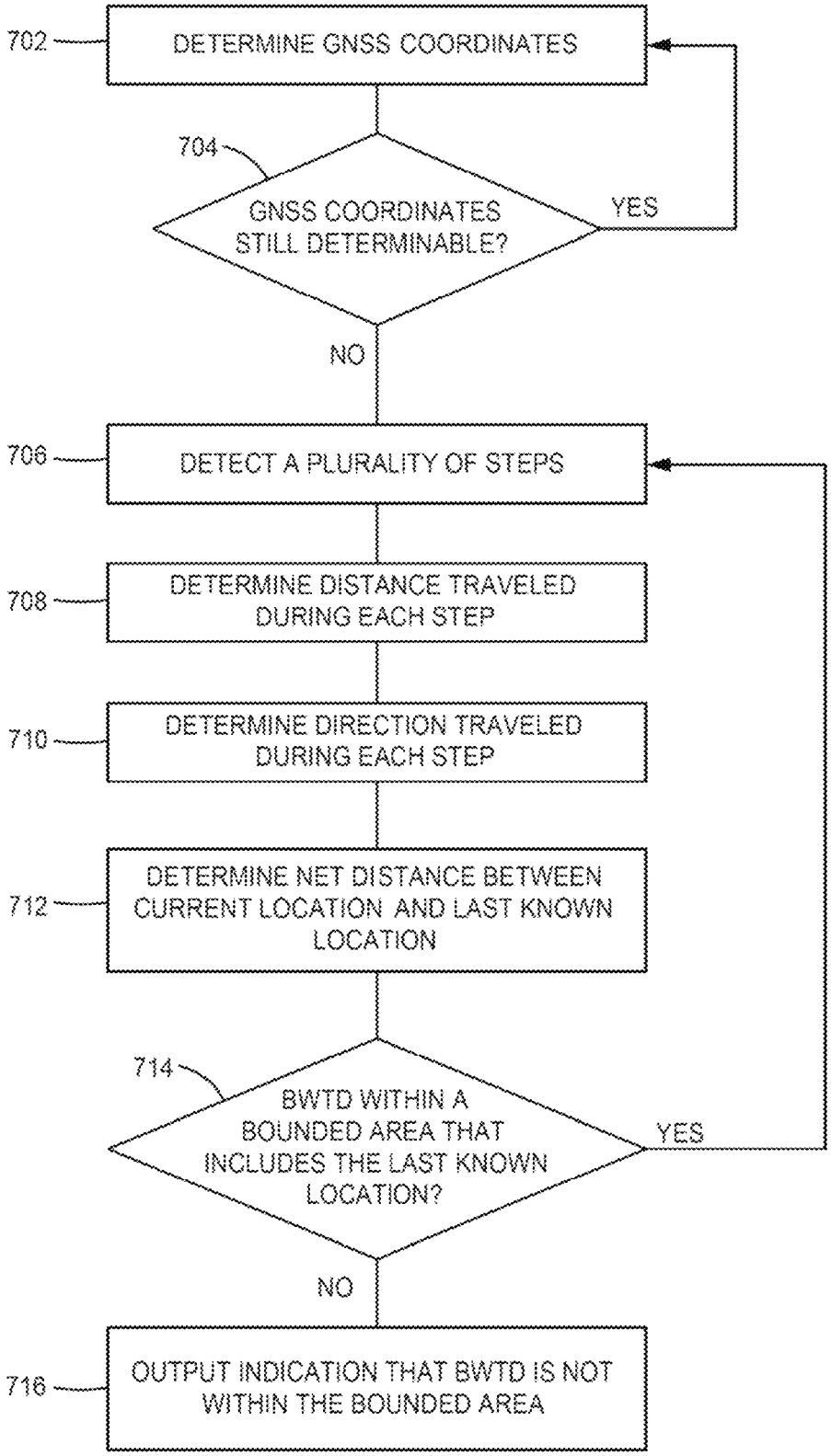
FIG. 7 is a flow diagram illustrating example operations of a computing device configured to determine whether a body-worn tracking devices is within a bounded geographic area, in accordance with techniques of this disclosure.

FIG. 7 is a flow diagram illustrating example operations of a computing device configured to determine one or more values that represent a monitoring attribute for one or more body-worn tracking devices, in accordance with techniques of this disclosure. While described with respect to the system shown in FIG. 1, it should be understood that the process described with respect to FIG. 7 may be carried out by a variety of other computing systems.

In some examples, BWTD 106A determines GNSS coordinates of a location of BWTD 106A at a particular time (702). For example, GNSS components 343 of BWTD 106A may receive GNSS signals from a threshold number (e.g., three or more) GNSS satellites 108 and may determine the GNSS coordinates of BWTD 106A based on the received GNSS signals. Each signal received from a respective satellite 108 includes data such as the location of the respective satellite 108 and the time at which the data was sent by the respective satellite. BWTD 106A may use trilateration to determine the location of BWTD 106A based on the data in the received GNSS signals.

At a later time, BWTD 106A may determine whether the GNSS coordinates of are still determinable (704). For example, BWTD 106A may determine whether GNSS components 343 of BWTD 106A are receiving GNSS signals from at least a threshold number of satellites 108, and if so, may determine that BWTD 106A can determine the GNSS coordinates from the received signals. In some examples, BWTD 106A may determine that the GNSS components 343 of BWTD 106A are receiving GNSS signals from fewer than the threshold number of satellites 108 such that BWTD 106A is unable to determine the current location of BWTD 106A using the GNSS components 343.

Responsive to determining that GNSS coordinates are still determinable ("Yes" branch of 704), BWTD 106A may determine the GNSS coordinates at a second time. BWTD 106A may store the GNSS coordinates and a timestamp for each set if GNSS coordinates. In some examples, BWTD 106A may send a unique identifier for BWTD 106A, GNSS coordinates, and timestamp to a monitoring center 112, where the unique identifier, GNSS coordinates, and timestamp may be stored by one or more server devices 114.

Responsive to determining that the GNSS coordinates cannot be determined using the GNSS components 343 ("No" branch of 704), BWTD 106A detects a plurality of steps (706). In some examples, acceleration components 346 generate acceleration data and BWTD 106A compares the acceleration data to a template acceleration pattern to detect a plurality of steps or strides. In some examples, gyroscope components 346 generate orientation data and BWTD 106A compares the orientation data to a template orientation pattern to detect a plurality of steps or strides. BWTD 106A may more accurately detect steps by comparing the acceleration data and the orientation data to the respective template data patterns.

BWTD 106A determines the distance traveled during each step in the plurality of steps (708). In some scenarios, BWTD 106A determines the distance traveled by each step by querying storage components 338 to retrieve a predetermined estimate of a stride length. In some instances, BWTD 106A determines the distance traveled by each step based on the acceleration data generated by acceleration components 346. For instance, BWTD 106A may integrate the acceleration data to determine the distance traveled during each step.

In some examples, BWTD 106A determines the direction traveled during each step of the plurality of steps (710). BWTD 106A may determine the direction traveled based on orientation data generated by gyroscope components 348. For instance, BWTD 106A may integrate the orientation data to determine the change in orientation or direction of BWTD 106A during each step. In some examples, BWTD 106A calibrates the data generated by gyroscope components 348 using data generated by magnetometer components 350, which may improve the accuracy of the determined direction.

BWTD 106 determines the net distance between the last known location of BWTD 106A and the current positon of BWTD 106A (712). BWTD 106A may determine the net distance based on the distance traveled during each step and the direction traveled during each step. For example, each step may be represented by a vector that includes the distance and direction of the respective step. In these examples, BWTD 106A may sum the vectors to determine the net distance and net direction traveled during the plurality of steps that occurred between the last known location and the current location of BWTD 106A.

BWTD 106A determines whether BWTD 106A is within a bounded area that includes the last known location of BWTD 106A (714). In some examples, BWTD 106A determines whether BWTD 106A is within the bounded area by determining whether the net distance satisfies the threshold distance. For instance, the bounded area may be represented by a circle and the threshold distance may be the radius of the circle. For example, BWTD 106A may determine that BWTD 106A is within the bounded area based on determining that the net distance satisfies (e.g., is less than or equal to) the threshold distance. In contrast, BWTD 106A may determine that BWTD 106A is not within the bounded area if the net distance does not satisfy (e.g., is greater than) the threshold distance.

In some examples, BWTD 106A determines whether BWTD 106A is within the bounded area based on the net distance and the net direction traveled during the plurality of steps. For example, the bounded area may be represented by a shape other than a circle such that BWTD 106A may travel outside the bounded area if traveling a certain distance in one direction while BWTD 106A may remain within the bounded area if traveling the same distance in a different direction. In some examples, BWTD 106A may determine the bounded area by querying storage components 338 to determine coordinates defining the bounded area (e.g., 4 coordinate sets may define a rectangular bounded area) and determine whether BWTD 106A remains within the bounded area based on the net displacement and net direction.

Responsive to determining that BWTD 106A is within the bounded area ("Yes" branch of 714), BWTD 106A may continue detecting steps and update the net distance and net direction traveled during the plurality of steps. Responsive to determining that BWTD 106A is not within the bounded area ("No" branch of 714), BWTD 106A may output an indication that BWTD 106A is not within the bounded area. For example, BWTD 106A may send a message to another computing device (e.g., sever devices 114 of monitoring center 112, or to a mobile device associated with the monitored person 104A assigned to wear BWTD 106A) indicating BWTD 106A is not in a permissible area. As another example, BWTD 106A may output a notification (e.g., audible, visual, or tactile) indicating that BWTD 106A is not within a bounded area. For instance, BWTD 106A may vibrate, which may indicate to the monitored person 104A assigned to wear BWTD 106A that he or she should return to the bounded area or proceed to an area where BWTD 106A may reestablish a connection to GNSS satellites and determine the GNSS coordinates of BWTD 106A.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor", as used may refer to any of the foregoing structure or any other structure suitable for implementation of the techniques described. In addition, in some aspects, the functionality described may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

It is to be recognized that depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially.

In some examples, a computer-readable storage medium includes a non-transitory medium. The term "non-transitory" indicates, in some examples, that the storage medium is not embodied in a carrier wave or a propagated signal. In certain examples, a non-transitory storage medium stores data that can, over time, change (e.g., in RAM or cache).

Various examples have been described. These and other examples are within the scope of the following claims.

What is claimed is:

1. A body-worn tracking device (BWTD) comprising:
a global navigation satellite system (GNSS) device;
at least one motion sensor;
at least one processor; and
at least one memory device comprising instructions that, when executed by the at least one processor, cause the at least one processor to:
responsive to determining that a current location of the BWTD cannot be determined using the GNSS device, determine, based on data generated by the at least one motion sensor, a net distance between the last known location of the BWTD and the current location of the BWTD;

determine, based on the net distance, whether the BWTD is within a bounded area that includes the last known location;

responsive to determining that BWTD is not within the bounded area, output an indication that the BWTD is not within the bounded area;

wherein the bounded area is automatically adjusted based on information of past use of the BWTD by a monitored person; and wherein the past use includes how quickly the monitored person re-establishes a GNSS signal when GNSS coverage is lost.

2. The BWTD of claim 1, wherein the at least one motion sensor comprises:

an accelerometer; and a gyroscope;

wherein the instructions that cause at least one processor to determine the net distance cause the at least one processor to determine the net distance based on data generated by the accelerometer and data generated by the gyroscope, wherein the instructions that cause the at least one processor to determine the net distance cause the at least one processor to:

detect, based on the data generated by the accelerometer, a plurality of steps;

determine an estimated distance traveled during each step of the plurality of steps;

determine, based on the data generated by the gyroscope, a direction of travel of each step of the plurality of steps;

determine, based on the estimated distance traveled during each step and the direction of travel of each step, the net distance between the last known location of the BWTD and the current location of the BWTD;

wherein the BWTD further comprises a magnetometer, and wherein the at least one processor is further configured to:

calibrate, based on data generated by the magnetometer, the gyroscope.

3. The BWTD of claim 1, wherein the motion data generated by the at least one motion sensor comprises first motion data, wherein the instructions further cause the at least one processor to:

determine, based on data generated by the GNSS device and second data generated by the at least one motion sensor, a stride length of a person wearing the BWTD;

wherein the bounded area comprises a circle surrounding the last known location of the BWTD; and wherein the net distance includes a straight-line distance between the last known location of the BWTD and the current location of the BWTD.

4. The BWTD of claim 1, wherein the instructions that cause the at least one processor to determine whether the BWTD is within the bounded area cause the at least one processor to:

determine whether the net distance satisfies a threshold distance; and responsive to determining that the net distance does not satisfy the threshold distance, determine that the BWTD is not within the bounded area.

5. The BWTD of claim 1, wherein the instructions that cause the at least one processor to determine whether the BWTD is within the bounded area further cause the at least one processor to determine whether the BWTD is within the bounded area based on:

the net distance between the last known location of the BWTD and the current location of the BWTD, and a net direction between the last known location of the BWTD and the current location of the BWTD.

6. The BWTD of claim 1, wherein the instructions further cause the at least one processor to determine, based at least in part on a context of the BWTD, the bounded area, wherein the context of the BWTD includes a current day or current time.

7. The BWTD of claim 1, wherein instructions further cause the at least one processor to:

responsive to receiving a plurality of coordinates defining the bounded area, store the plurality of coordinates in the at least one memory device.

8. A method comprising:

determining, by at least one processor of a body-worn tracking device (BWTD), that a current location of the BWTD cannot be determined using a global navigation satellite system (GNSS) device of the BWTD;

responsive to determining that the current location of the BWTD cannot be determined using the GNSS device of the BWTD, determining, by the at least one processor and based on data generated by at least one motion sensor of the BWTD, a net distance between the last known location of the BWTD and a current location of the BWTD;

determining, by the at least one processor and based on the net distance, whether the BWTD is within a bounded area that includes the last known location;

responsive to determining that BWTD is not within the bounded area, outputting, by the at least one processor, an indication that the BWTD is not within the bounded area;

wherein the bounded area is automatically adjusted based on information of past use of the BWTD by a monitored person; and wherein the past use includes how quickly the monitored person re-establishes a GNSS signal when GNSS coverage is lost.

9. The method of claim 8, further comprising:

receiving, by the at least one processor, data generated by an accelerometer of the BWTD, receiving, by the at least one processor, data generated by a gyroscope of the BWTD, wherein determining the net distance includes determining the net distance based on the data generated by the accelerometer and the data generated by the gyroscope wherein determining the net distance comprises:

determining, by the at least one processor, based on the data received from the accelerometer, a plurality of steps;

determining, by the at least one processor, an estimated distance traveled during each step of the plurality of steps;

determining, by the at least one processor, based on the data received from the gyroscope, a direction of travel of each step of the plurality of steps;

determining, by the at least one processor, based on the distance traveled during each step and the direction of travel of each step, the net distance between the last known location of the BWTD and the current location of the BWTD, and;

calibrating, by the at least one processor, based on data received from a magnetometer of the BWTD, the gyroscope.

10. The method of claim 8, wherein the motion data received by the at least one motion sensor comprises first motion data, the method further comprising:

determining, by the at least one processor, based on location data received from the GNSS device and second data received from the at least one motion sensor, a stride length of a person wearing the BWTD.

11. The method of claim 8, wherein the bounded area comprises a circle surrounding the last known location of the BWTD.

12. The method of claim 8, wherein determining whether the BWTD is within the bounded area comprises:

determining, by the at least one processor, whether the net distance satisfies a threshold distance; and responsive to determining that the net distance does not satisfy the threshold distance, determining, by the at least one processor, that the BWTD is not within the bounded area.

13. The method of claim 8, wherein determining whether the BWTD is within the bounded area is further based on a net direction between the last known location of the BWTD and the current location of the BWTD.

14. The method of claim 8, further comprising:

determining, based at least in part on a context of the BWTD, the bounded area, wherein the context of the BWTD includes a current day or current time.

15. The method of claim 8, further comprising:

receiving, by the at least one processor and from a remote computing device, a plurality of coordinates defining the bounded area; and storing, by the at least one processor, the plurality of coordinates to the at least one memory device.

16. The method of claim 8, wherein the at least one processor of the BWTD comprises a first processor, the method further comprising:

updating, by at least a second processor of a server device, the bounded area; and sending, by the at least second processor of the server device and to the BWTD, an indication of the updated bounded area, outputting, by at least a second processor of a server device, for display, a graphical user interface (GUI) comprising an indication of a person assigned to wear the BWITD and an indication of the bounded area; and receiving, by the at least second processor of the server device, a user input adjusting the bounded area; and wherein updating the bounded area comprises updating the bounded area based on the user input.

17. The method of claim 16, wherein updating the bounded area of the BWTD comprises:

determining, by the at least second processor of the server device, that the last known location of the BWTD corresponds to a particular building; and updating, by the at least second processor of the server device, the bounded area to include at least a portion of the particular building.

18. The method of claim 8, wherein the net distance includes a straight-line distance between the last known location of the BWTD and the current location of the BWTD.

19. The BWTD of claim 1, wherein the past use includes a compliance level of the monitored person.

* * * * *